US008963912B2

(12) United States Patent
Yukawa

(10) Patent No.: US 8,963,912 B2
(45) Date of Patent: Feb. 24, 2015

(54) DISPLAY DEVICE AND DISPLAY DEVICE DRIVING METHOD

(75) Inventor: Shinji Yukawa, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 317 days.

(21) Appl. No.: 13/382,167

(22) PCT Filed: May 12, 2010

(86) PCT No.: PCT/JP2010/058037

§ 371 (c)(1),
(2), (4) Date: Jan. 4, 2012

(87) PCT Pub. No.: WO2011/007613

PCT Pub. Date: Jan. 20, 2011

(65) Prior Publication Data

US 2012/0127153 A1 May 24, 2012

(30) Foreign Application Priority Data

Jul. 17, 2009 (JP) ..... 2009-169536

(51) Int. Cl.
*G09G 3/36* (2006.01)

(52) U.S. Cl.
CPC ..... *G09G 3/3648* (2013.01); *G09G 3/3614* (2013.01); *G09G 2300/0426* (2013.01); *G09G 2300/0452* (2013.01); *G09G 2310/0205* (2013.01); *G09G 2310/0232* (2013.01); *G09G 2310/0251* (2013.01); *G09G 2310/08* (2013.01);

(Continued)

(58) Field of Classification Search
CPC ..... G09G 3/3614; G09G 3/3648; G09G 2300/0426; G09G 2300/0452; G09G 2310/0205; G09G 2310/0232; G09G 2310/0251; G09G 2310/08; G09G 2320/0223
See application file for complete search history.

(56) References Cited

U.S. PATENT DOCUMENTS

2004/0246404 A1 12/2004 Elliott et al.
2005/0231455 A1 10/2005 Moon (Continued)

FOREIGN PATENT DOCUMENTS

CN 1912721 2/2007
JP 2001042287 A 2/2001

(Continued)

OTHER PUBLICATIONS

International Search Report and Written Opinion of Searching Authority.

*Primary Examiner* — Aneeta Yodichkas
*Assistant Examiner* — Neil Wood
(74) *Attorney, Agent, or Firm* — Harness, Dickey & Pierce, P.L.C.

(57) ABSTRACT

The present invention is an active matrix display device in which, during each kth period (k is an integer from 0 to n), each data signal line (S1to S2773) is supplied with a signal whose electric potential polarity is constant, and a picture element to which a signal finishes being written within the kth period is caused to be in a selected state from a (k−1)th period to the kth period so as to be conductive to a data signal line connected thereto, and during each kth period (1≤k≤n−1) for the effective display region, a data signal line (S1 or S2773) that is not connected to a picture element to which a signal finishes being written within the kth period is supplied with a signal that was supplied to this data signal line during the (k−1)th period.

10 Claims, 12 Drawing Sheets

(52) U.S. Cl.
CPC .... *G09G 2320/0223* (2013.01); *G09G 2340/06* (2013.01)
USPC ..... 345/215

(56) References Cited

U.S. PATENT DOCUMENTS

| | | | | |
|---|---|---|---|---|
| 2006/0158412 | A1* | 7/2006 | Morita | 345/94 |
| 2006/0208984 | A1 | 9/2006 | Kim et al. | |
| 2006/0284815 | A1 | 12/2006 | Kwon et al. | |
| 2007/0035687 | A1 | 2/2007 | Oke et al. | |
| 2007/0091044 | A1 | 4/2007 | Park et al. | |
| 2007/0097072 | A1* | 5/2007 | Kim et al. | 345/103 |
| 2008/0079755 | A1* | 4/2008 | Shiomi | 345/690 |
| 2008/0100603 | A1* | 5/2008 | Matsuda et al. | 345/205 |
| 2008/0150871 | A1 | 6/2008 | Park | |
| 2008/0158125 | A1 | 7/2008 | Mori et al. | |
| 2008/0231769 | A1* | 9/2008 | Cho et al. | 349/37 |
| 2009/0303166 | A1* | 12/2009 | Tsubata | 345/87 |

FOREIGN PATENT DOCUMENTS

| | | | |
|---|---|---|---|
| JP | 2006-106062 | A | 4/2006 |
| JP | 2008026377 | A | 2/2008 |
| JP | 2008164952 | A | 7/2008 |
| JP | 2009086564 | A | 4/2009 |

* cited by examiner

DISPLAY DEVICE AND DISPLAY DEVICE DRIVING METHOD

TECHNICAL FIELD

The present invention relates to a display device and a display device driving method. In particular, the present invention relates to a technique of pre-charging picture elements in a display section.

BACKGROUND ART

Conventionally, in a liquid crystal display device, for the purpose of improving display quality of liquid crystal panels having a large number of pixels and a high aperture ratio which increase with each passing year, there have been developed various methods for driving picture elements in a liquid crystal panel. Out of such various driving methods, alternate current (AC) driving includes frame reversal driving, line reversal driving, and dot reversal driving. Also, a combination of these driving methods can be used.

Usually, a liquid crystal panel has a plurality of picture elements arranged in a matrix manner, a gate bus line provided for each row for selecting each row of picture elements, and a source bus line provided for each column for supplying a data signal to each column of picture elements. The picture elements are driven in such a manner that (i) while the source bus lines are supplied with data signals, a gate bus line is scanned and thereby picture elements are selected and (ii) the data signals are applied to these selected picture elements. Such an operation of driving picture elements is common to various driving methods.

Meanwhile, in order to suppress a deterioration of picture elements, a data signal applied to the picture elements is switched between a positive polarity and a negative polarity relative to a common electric potential. In particular, dot reversal driving is known to be good for improving image quality. This is because the dot reversal driving causes a data signal applied to a picture element to have a polarity reverse to those of adjacent picture elements located on the upper, lower, right and left sides, thereby achieving stable input of picture element electric potentials.

Note however that, in the dot reversal driving, since a period in which an electric potential of each source bus line is rewritten is shortened as a scanning speed increases, a problem occurs in which the picture elements are not sufficiently charged. Further, in view of power consumption, it is desired that this period be long.

Under such circumstances, for example, Patent Literature 1 describes a technique of carrying out driving that looks like dot reversal driving, by arranging pixels so that they are alternately connected to source bus lines. According to the technique, (i) one (1) source bus line is added so that pixels in each column are connected one-by-one alternately to an adjacent source bus line located on their left side and an adjacent source bus line located on their right side and (ii) data signals are supplied to the source bus lines such that a polarity is the same between pixels adjacent to each other in a row direction, polarities of pixels adjacent to each other in a column direction are reverse to each other, and such polarity relation is reversed for every one (1) field. This makes it possible to carry out driving that looks like dot reversal driving, while causing each source bus line to have the same polarity over one (1) field period.

CITATION LIST

Patent Literature

Patent Literature 1

Japanese Patent Application Publication, Tokukai, No. 2001-42287 A (Publication Date: Feb. 16, 2001)

SUMMARY OF INVENTION

Technical Problem

Meanwhile, in any of the various driving methods, there has been a problem that the electric potential of a picture element does not reach the electric potential of a data signal applied. This is because a driving time for every picture element is shortened because there was no choice but to shorten one (1) horizontal period as the number of pixels increases etc. or because resistance and capacitance of a source bus line become large as the length of the source bus line increases in a liquid crystal panel having large area. Insufficient electric potential, i.e., insufficient charging, of picture elements would result in display unevenness or a reduction in contrast, and thus lead to a reduction in display quality. In view of this, there has been carried out pre-charging of picture elements prior to actual changing.

Note however that, in a configuration in which, in each column, a pixel connected to an adjacent source bus line located on its left side and a pixel connected to an adjacent source bus line located on its right side are alternately arranged like the technique described in Patent Literature 1, if pre-charging is carried out with use of a data signal for a previous row by increasing an output period of a scanning signal, a problem occurs in which dot-like unevenness occurs only in right and left edge portions of a display screen.

FIG. 11 illustrates a liquid crystal panel 100 in which two picture elements 101 adjacent to each other in a vertical direction×two picture elements 101 adjacent to each other in a horizontal direction constitute a single pixel 102 of RGB and which is configured such that, in each column, picture elements 101 connected to an adjacent source bus line located on their left side and picture elements 101 connected to an adjacent source bus line located on their right side are arranged two-by-two alternately. Note that, hereinafter, a configuration in which some of picture elements in each column are connected to an adjacent source bus line located on the left side and the others are connected to an adjacent source bus line located on the right side is referred to as staggered arrangement.

As illustrated in FIG. 11, in a case of staggered arrangement, to each of the leftmost and rightmost source bus lines S1 and S2773, picture elements 101 are connected every two rows. In other words, when each row is focused on, no picture element 101 is connected to the source bus line S1 or the source bus line S2773 in some rows (e.g., parts indicated by arrows in FIG. 11).

Therefore, for example in a horizontal period during which data signals are written into picture elements 101 connected to a gate bus line G2, the source bus line S2773 to which no picture element 101 is connected is not supplied with a data signal. Instead, the source bus line S2773 is supplied with a lowest gray scale voltage (e.g., black voltage in a case of normally black). As a result, when data signals are written into picture elements 101 connected to a gate bus line G3, if the picture elements 101 are to be pre-charged with use of output for a previous row by being supplied with a scanning signal from a previous horizontal period and thereafter to be actually charged, only the endmost picture element 101 is not pre-charged and therefore may not reach a desired electric potential because the source bus line S2773 had not been supplied with a data signal.

As has been described, according to the configuration of staggered arrangement, the leftmost and rightmost picture elements 101 may be charged at a speed different from those for the other picture elements 101. If this is the case, a difference occurs in electric potentials that liquid crystal reaches after being charged. As a result, as illustrated in FIG. 12, only the left and right edge portions of the display screen have different luminance, thereby causing dot-like unevenness. This is particularly noticeable in a display pattern of for example halftone gray solid color.

Note that, in a case where the liquid crystal panel 100 is a normally black (NB) liquid crystal panel, usually, a non-display region is supplied with a black voltage, which is the lowest gray scale voltage. Therefore, the foregoing unevenness looks slightly more black than the other regions. On the other hand, in a case where the liquid crystal panel 100 is a normally white (NW) liquid crystal panel, usually, a non-display region is supplied with a white voltage, which is the lowest gray scale voltage. Therefore, the foregoing unevenness looks slightly more white than the other regions.

The present invention has been made in view of the conventional problem, and an object of the present invention is to provide a display device and a display device driving method each of which is capable of eliminating, in a configuration including a display section having staggered arrangement, while carrying out pre-charging with use of previous output, dot-like unevenness occurring in the left and right edge portions of a display screen.

Solution to Problem

In order to attain the above object, a display device in accordance with the present invention is an active matrix display device including: picture elements in each column of an effective display region, some of the picture elements being connected to an adjacent data signal line located on one side of the picture elements and the others being connected to an adjacent data signal line located on the other side of the picture elements, wherein a period that is equivalent in length to one horizontal period and immediately precedes a first period serves as a zeroth period, the first period being a horizontal period during which a signal finishes being written first in the effective display region, during each kth period (k is an integer from 0 to n) of successive periods from the zeroth period to a nth period, (n is an integer) which is a horizontal period during which a signal finishes being written lastly in the effective display region, each data signal line is supplied with a signal whose electric potential polarity relative to a common electric potential is constant and whose electric potential polarity is reverse to that of a signal supplied to a data signal line that is adjacent to said each data signal line, a picture element to which a signal finishes being written within the kth period in the effective display region is caused to be in a selected state from a (k−1)th period to the kth period so as to be conductive to a data signal line connected thereto, and during each kth period ($1 \le k \le n-1$) for the effective display region, a data signal line that is not connected to a picture element to which a signal finishes being written within the kth period is supplied with a signal that was supplied to this data signal line during the (k−1)th period.

Further, a display device driving method in accordance with the present invention is a method for driving an active matrix display device including picture elements in each column of an effective display region, some of the picture elements being connected to an adjacent data signal line located on one side of the picture elements and the others being connected to an adjacent data signal line located on the other side of the picture elements, wherein a period that is equivalent in length to one horizontal period and immediately precedes a first period serves as a zeroth period, the first period being a horizontal period during which a signal finishes being written first in the effective display region, and during each kth period (k is an integer from 0 to n) of successive periods from the zeroth period to a nth period (n is an integer) which is a horizontal period during which a signal finishes being written lastly in the effective display region, each data signal line is supplied with a signal whose electric potential polarity relative to a common electric potential is constant and whose electric potential polarity is reverse to that of a signal supplied to a data signal line that is adjacent to said each data signal line, said method including the steps of: causing a picture element to which a signal finishes being written within the kth period in the effective display region to be in a selected state from a (k−1)th period to the kth period so that the picture element is conductive to a data signal line connected thereto; and during each kth period ($1 \le k \le n-1$) for the effective display region, supplying, to a data signal line that is not connected to a picture element to which a signal finishes being written within the kth period, a signal that was supplied to this data signal line during the (k−1)th period.

According to the configuration, (i) in each column of the effective display region, some of the picture elements are connected to an adjacent data signal line located on one side of the picture elements and the others are connected to an adjacent data signal line located on the other side of the picture elements (such arrangement is hereinafter referred to as staggered arrangement) and each data signal lines is supplied with a signal whose electric potential polarity relative to a common electric potential is constant and whose electric potential polarity is reverse to that of a signal supplied to a data signal line that is adjacent to said each data signal line. Therefore, dot reversal driving can be carried out substantially.

Further, during each kth period (k is an integer from 0 to n) of successive periods, a picture element to which a signal finishes being written within the kth period in the effective display region is caused to be in a selected state from the (k−1)th period to the kth period so as to be conductive to a data signal line connected thereto. Accordingly, the picture element to which a signal finishes being written within the kth period in the effective display region is pre-charged by a signal which has the same polarity and is supplied during the (k−1)th period that is one period preceding the kth period, and thereafter is actually charged. As such, even in a case where an actual charging period is short, it is possible to sufficiently reach an electric potential of a signal to be written.

Meanwhile, conventionally, during each horizontal period for the effective display region, a data signal line that is not connected to a picture element to which a signal finishes being written within the foregoing each horizontal period is regarded as a non-display region and is always supplied with a lowest gray scale voltage (e.g., black voltage in a case of normally black). Therefore, in a row at which connection of picture elements to data signal lines is switched from that in a previous row, the leftmost or rightmost picture element is not pre-charged during a previous horizontal period and thus it is not possible to cause the leftmost or rightmost picture element to sufficiently reach a desired electric potential within an actual horizontal period.

In this regard, according to the above configuration, during each kth period ($1 \leq k \leq n-1$) for the effective display region, a data signal line that is not connected to a picture element to which a signal finishes being written within the kth period is supplied with a signal that was supplied to this data signal line during the (k−1)th period. This prevents output voltages for the data signal lines in a pre-charging period from being different between (i) the leftmost or rightmost picture element and (ii) the other picture elements in a row at which connection of picture elements to data signal lines is switched from that in a previous row, and thus makes it possible to cause liquid crystal to be evenly charged.

Accordingly, in a configuration including a display section having staggered arrangement, it is possible to eliminate dot-like unevenness occurring in the left and right edge portions of the display screen while carrying out pre-charging with use of previous output.

Note that, the display device in accordance with the present invention can be configured as below.

That is, a display device in accordance with the present invention is an active matrix display device including: picture elements in each column of an effective display region, some of the picture elements being connected to an adjacent data signal line located on one side of the picture elements and the others being connected to an adjacent data signal line located on the other side of the picture elements, wherein a period that is equivalent in length to one horizontal period and immediately precedes a first period serves as a zeroth period, the first period being a horizontal period during which a signal finishes being written first in the effective display region, during each kth period (k is an integer from 0 to n) of successive periods from the zeroth period to a nth period (n is an integer) which is a horizontal period during which a signal finishes being written lastly in the effective display region, each data signal line is supplied with a signal whose electric potential polarity relative to a common electric potential is constant and whose electric potential polarity is reverse to that of a signal supplied to a data signal line that is adjacent to said each data signal line, a picture element to which a signal finishes being written within the kth period in the effective display region is caused to be in a selected state from a (k−1)th period to the kth period so as to be conductive to a data signal line connected thereto, and during each kth period ($1 \leq k \leq n-1$) for the effective display region, a data signal line that is not connected to a picture element to which a signal finishes being written within the kth period is supplied with a signal corresponding to gray data.

Alternatively, a display device in accordance with the present invention is an active matrix display device including: picture elements in each column of an effective display region, some of the picture elements being connected to an adjacent data signal line located on one side of the picture elements and the others being connected to an adjacent data signal line located on the other side of the picture elements, wherein a period that is equivalent in length to one horizontal period and immediately precedes a first period serves as a zeroth period, the first period being a horizontal period during which a signal finishes being written first in the effective display region, during each kth period (k is an integer from 0 to n) of successive periods from the zeroth period to a nth period (n is an integer) which is a horizontal period during which a signal finishes being written lastly in the effective display region, each data signal line is supplied with a signal whose electric potential polarity relative to a common electric potential is constant and whose electric potential polarity is reverse to that of a signal supplied to a data signal line that is adjacent to said each data signal line, a picture element to which a signal finishes being written within the kth period in the effective display region is caused to be in a selected state from a (k−1)th period to the kth period so as to be conductive to a data signal line connected thereto, and during each kth period ($1 \leq k \leq n-1$) for the effective display region, a data signal line that is not connected to a picture element to which a signal finishes being written within the kth period but is connected to another picture element to which a signal finishes being written within a (k+1)th period is supplied with either a signal corresponding a lowest luminance gray level or a signal corresponding to a highest luminance gray level depending on the signal to be written to said another picture element during the (k+1)th period.

Note that, the display device driving method in accordance with the present invention can be configured as below.

That is, a display device driving method in accordance with the present invention is a method for driving an active matrix display device including picture elements in each column of an effective display region, some of the picture elements being connected to an adjacent data signal line located on one side of the picture elements and the others being connected to an adjacent data signal line located on the other side of the picture elements, wherein a period that is equivalent in length to one horizontal period and immediately precedes a first period serves as a zeroth period, the first period being a horizontal period during which a signal finishes being written first in the effective display region, and during each kth period (k is an integer from 0 to n) of successive periods from the zeroth period to a nth period (n is an integer) which is a horizontal period during which a signal finishes being written lastly in the effective display region, each data signal line is supplied with a signal whose electric potential polarity relative to a common electric potential is constant and whose electric potential polarity is reverse to that of a signal supplied to a data signal line that is adjacent to said each data signal line, said method including the steps of: causing a picture element to which a signal finishes being written within the kth period in the effective display region to be in a selected state from a (k−1)th period to the kth period so that the picture element is conductive to a data signal line connected thereto; and during each kth period ($1 \leq k \leq n-1$) for the effective display region, supplying a signal corresponding to gray data to a data signal line that is not connected to a picture element to which a signal finishes being written within the kth period.

Alternatively, a display device driving method in accordance with the present invention is a method for driving an active matrix display device including picture elements in each column of an effective display region, some of the picture elements being connected to an adjacent data signal line located on one side of the picture elements and the others being connected to an adjacent data signal line located on the other side of the picture elements, wherein a period that is equivalent in length to one horizontal period and immediately precedes a first period serves as a zeroth period, the first period being a horizontal period during which a signal finishes being written first in the effective display region, and during each kth period (k is an integer from 0 to n) of successive periods from the zeroth period to a nth period (n is an integer) which is a horizontal period during which a signal finishes being written lastly in the effective display region, each data signal line is supplied with a signal whose electric potential polarity relative to a common electric potential is constant and whose electric potential polarity is reverse to that of a signal supplied to a data signal line that is adjacent to said each data signal line, said method including the steps of: causing a picture element to which a signal finishes being written within the kth period in the effective display region to be in a selected state from a (k−1)th period to the kth period so that the picture element is conductive to a data signal line connected thereto; and during each kth period (1≤k≤n−1) for the effective display region, supplying, to a data signal line that is not connected to a picture element to which a signal finishes being written within the kth period but is connected to another picture element to which a signal finishes being written within a (k+1)th period, either a signal corresponding a lowest luminance gray level or a signal corresponding to a highest luminance gray level depending on the signal to be written to said another picture element during the (k+1)th period.

Advantageous Effects of Invention

As has been described, a display device in accordance with the present invention is an active matrix display device including: picture elements in each column of an effective display region, some of the picture elements being connected to an adjacent data signal line located on one side of the picture elements and the others being connected to an adjacent data signal line located on the other side of the picture elements, wherein a period that is equivalent in length to one horizontal period and immediately precedes a first period serves as a zeroth period, the first period being a horizontal period during which a signal finishes being written first in the effective display region, during each kth period (k is an integer from 0 to n) of successive periods from the zeroth period to a nth period (n is an integer) which is a horizontal period during which a signal finishes being written lastly in the effective display region, each data signal line is supplied with a signal whose electric potential polarity relative to a common electric potential is constant and whose electric potential polarity is reverse to that of a signal supplied to a data signal line that is adjacent to said each data signal line, a picture element to which a signal finishes being written within the kth period in the effective display region is caused to be in a selected state from a (k−1)th period to the kth period so as to be conductive to a data signal line connected thereto, and during each kth period (1≤k≤n−1) for the effective display region, a data signal line that is not connected to a picture element to which a signal finishes being written within the kth period is supplied with a signal that was supplied to this data signal line during the (k−1)th period.

Further, a display device driving method in accordance with the present invention is a method for driving an active matrix display device including picture elements in each column of an effective display region, some of the picture elements being connected to an adjacent data signal line located on one side of the picture elements and the others being connected to an adjacent data signal line located on the other side of the picture elements, wherein a period that is equivalent in length to one horizontal period and immediately precedes a first period serves as a zeroth period, the first period being a horizontal period during which a signal finishes being written first in the effective display region, and during each kth period (k is an integer from 0 to n) of successive periods from the zeroth period to a nth period (n is an integer) which is a horizontal period during which a signal finishes being written lastly in the effective display region, each data signal line is supplied with a signal whose electric potential polarity relative to a common electric potential is constant and whose electric potential polarity is reverse to that of a signal supplied to a data signal line that is adjacent to said each data signal line, said method including the steps of: causing a picture element to which a signal finishes being written within the kth period in the effective display region to be in a selected state from a (k−1)th period to the kth period so that the picture element is conductive to a data signal line connected thereto; and during each kth period (1≤k≤n−1) for the effective display region, supplying, to a data signal line that is not connected to a picture element to which a signal finishes being written within the kth period, a signal that was supplied to this data signal line during the (k−1)th period.

That is, during each kth period (1≤k≤n−1) for the effective display region, a data signal line that is not connected to a picture element to which a signal finishes being written within the kth period is supplied with a signal that was supplied to this data signal line during the (k−1)th period. This prevents output voltages for the data signal lines in a pre-charging period from being different between (i) the leftmost or rightmost picture element and (ii) the other picture elements in a row at which connection of picture elements to data signal lines is switched from that in a previous row, and thus makes it possible to cause liquid crystal to be evenly charged.

Accordingly, in a configuration including a display section having staggered arrangement, it is possible to eliminate dot-like unevenness occurring in the left and right edge portions of the display screen while carrying out pre-charging with use of previous output.

DESCRIPTION OF EMBODIMENTS

Embodiment 1

The following description discusses an embodiment of the present invention with reference to the drawings.

Figure 1:
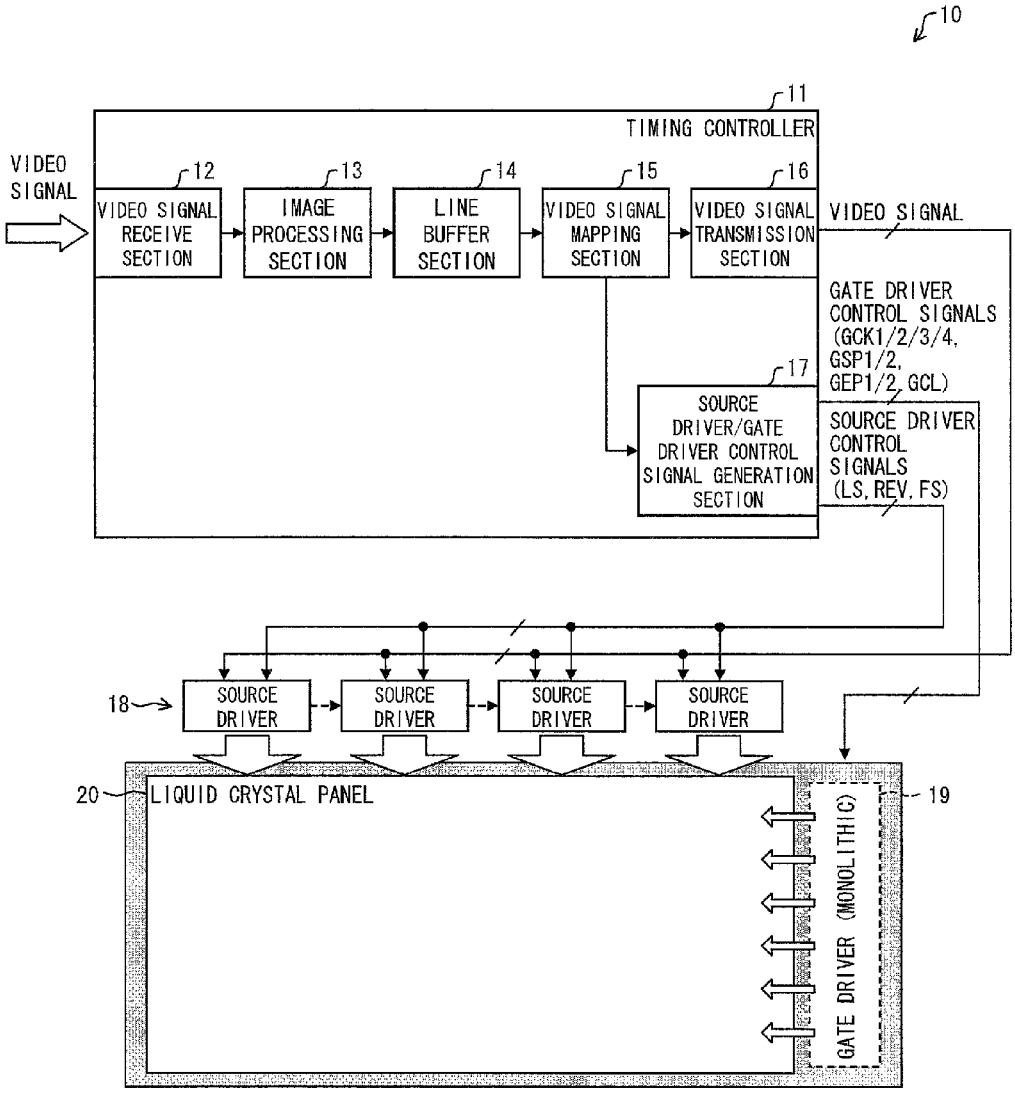
FIG. 1 is a view schematically illustrating an embodiment of a display device in accordance with the present invention.
Figure 2:
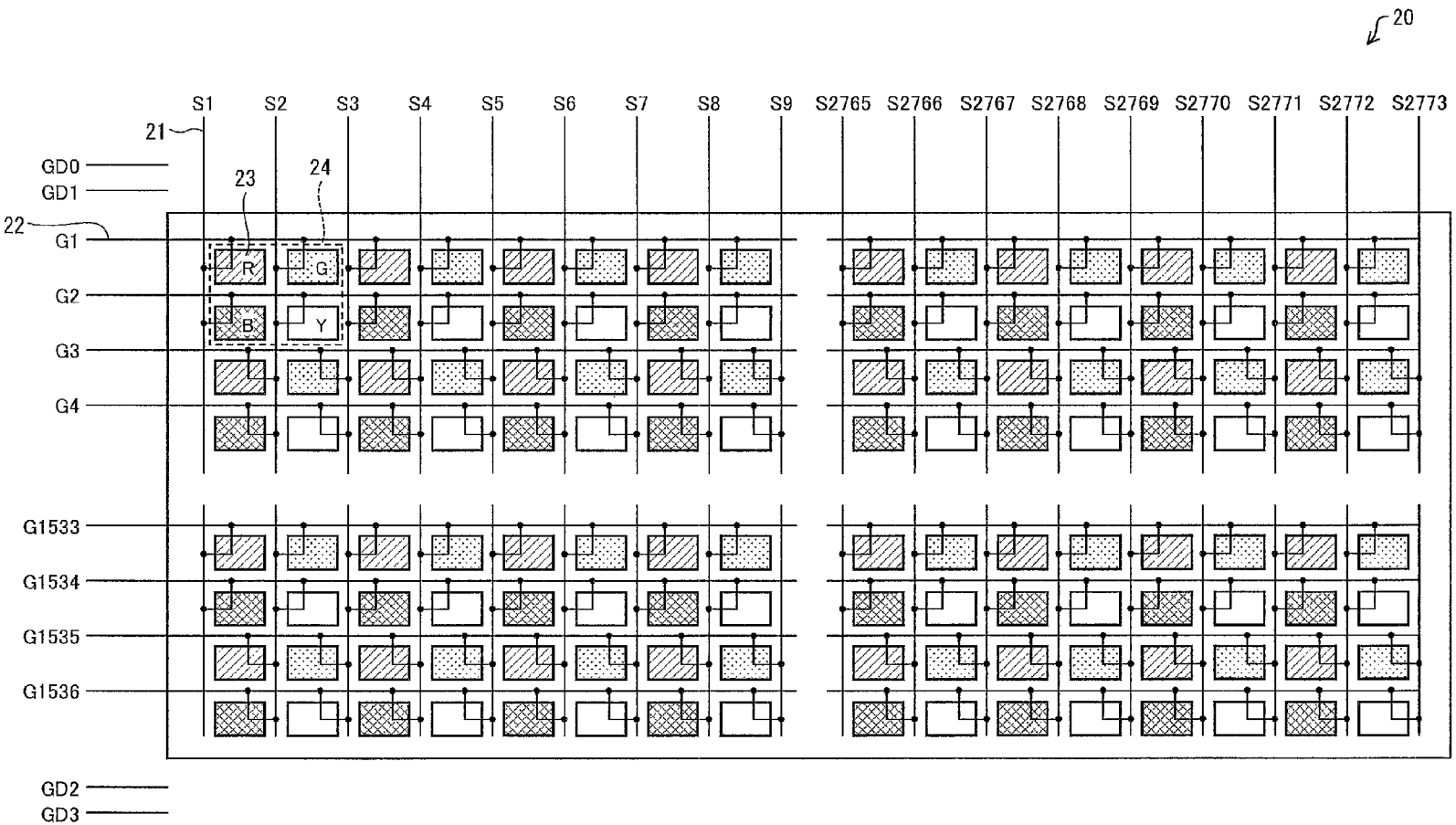
FIG. 2 is a plan view illustrating a configuration of a liquid crystal panel of the display device.

FIG. 1 is a view schematically illustrating an example of a configuration of a liquid crystal display device 10 of the present embodiment. FIG. 2 is a plan view illustrating an example of a configuration of a liquid crystal panel 20. It should be noted that FIGS. 1 and 2 illustrate characteristic parts, and omit as appropriate the other parts and well-known configurations.

The liquid crystal display device 10 is an active matrix display device, and includes a timing controller 11, a source driver 18, a gate driver 19 and a liquid crystal panel 20 (see FIG. 1). The liquid crystal display device 10 is for example constituted as, but not limited to, a liquid crystal module for TV.

The timing controller 11 is the one that controls supply of a video signal to the liquid crystal panel 20, and includes a video signal receive section 12, an image processing section 13, a line buffer section 14, a video signal mapping section 15, a video signal transmission section 16, and a source driver/gate driver control signal generation section 17.

The video signal receive section 12 receives a video signal based on an image to be displayed, which video signal is to be supplied to the liquid crystal panel 20. A video signal is for example a digital signal transmitted from CPU etc. via LVDS (Low Voltage Differential Signal) transmission. A liquid crystal module for TV mainly uses, but not limited to, the LVDS standard. The video signal receive section 12 supplies a received video signal to the image processing section 13.

The image processing section 13 carries out, with respect to a received video signal, image processing for improving display quality of the liquid crystal panel 20. The image processing section 13 mainly carries out, but not limited to, image processing such as Over-Drive, independent gamma correction, FRC (frame rate control) and/or Dither. The image processing section 13 supplies, to the line buffer section 14, a video signal that has been subjected to the image processing.

The line buffer section 14 temporarily stores therein video signals for several lines, for the purpose of timing control of video signals to be supplied to the liquid crystal panel 20 and control signals to be supplied to the source driver 18/gate driver 19. After the timing control, the line buffer section 14 supplies the video signals to the video signal mapping section 15.

The video signal mapping section 15 rearranges the video signals so that these video signals correspond to picture elements 23 of the liquid crystal panel 20. Specifically, since the picture elements 23 are arranged in a staggered manner (described later), a single source bus line 21 is connected to an adjacent picture element 23 located on its left side and an adjacent picture element 23 located on its right side. Therefore, the video signal mapping section 15 carries out, for each row, rearrangement of video signals to be supplied to the source driver 18 so that output is supplied to an appropriate source bus line 21. The video signal mapping section 15 further rearranges, in order for the video signal transmission section 16 to output video signals for a single row for example six at a time via mini-LDVS transmission, the video signals so that these video signals correspond to such output. It should be noted that the video signal mapping section 15 inserts dummy data when rearranging video signals for a single row. This is described later in detail. The video signal mapping section 15 supplies rearranged video signals to the video signal transmission section 16. Further, upon receiving video signals that need rearrangement, the video signal mapping section 15 supplies, to the source driver/gate driver control signal generation section 17, a notification signal informing that the video signal mapping section 15 received the video signals.

The video signal transmission section 16 supplies received video signals to the source driver 18. A liquid crystal module for TV uses mainly the mini-LVDS standard. However, needless to say, this does not imply any limitation.

In response to the notification signal from the video signal mapping section 15, the source driver/gate driver control signal generation section 17 generates source driver control signals and gate driver control signals. The source driver control signals include a latch signal LS, a reverse signal REV, and a frame start signal FS. The gate driver control signals include gate clock signals GCK1 to GCK4, gate start pulse signals GSP1 and GSP2, gate end pulse signals GEP1 and GEP2, and a signal GCL. The source driver/gate driver control signal generation section 17 supplies the source driver control signals to the source driver 18 and supplies the gate driver control signals to the gate driver 19.

The source driver 18 is a driver for generating and outputting data signals for driving the picture elements 23 of the liquid crystal panel 20. One or a plurality of source driver(s) 18 is/are provided for the purpose of achieving output suitable for source bus lines 21 (data signal lines) provided in the liquid crystal panel 20. The source driver 18 (i) latches video signals supplied from the timing controller 11 in accordance with the latch signal LS, (ii) generates data signals (analog gray scale voltage signals) based on respective video signals after receiving video signals for a single row, and (iii) supplies, at once, the data signals for a single row to their corresponding source bus lines 21 of the liquid crystal panel 20.

Further, the source driver 18 is configured to supply, to each source bus line 21, a data signal having a polarity reverse to that of an adjacent source bus line 21. Moreover, the source driver 18 (i) supplies data signals to the respective source bus lines 21 so that an electric potential polarity of each of the source bus lines 21 relative to a common electric potential does not change during a frame period and (ii) switches polarities for every frame period in accordance with the reverse signal REV which switches for every single frame. For example, during a frame period, when the reversal signal REV is at a high level, the source driver 18 supplies a data signal having a positive polarity to each of the odd-numbered source bus lines 21 and supplies a data signal having a negative polarity to each of the even-numbered source bus lines 21. When the reverse signal REV is at a low level, the source driver 18 supplies data signals having polarities opposite to the above.

The gate driver 19 is a driver for generating and outputting scanning signals for selecting picture elements 23 into which the data signals from the source driver 18 are to be written. The gate driver 19 is monolithically built in the liquid crystal panel 20 so as to achieve output suitable for gate bus lines 22 provided in the liquid crystal panel 20. The gate driver 19 generates scanning signals in accordance with the gate driver control signals, and supplies the scanning signals to their corresponding gate bus lines 22 of the liquid crystal panel 20.

The liquid crystal panel 20 is constituted by two transparent substrates facing each other and liquid crystal sealed between the two transparent substrates, and is the one that displays an image by electrically changing orientations of liquid crystal molecules. One of the transparent substrates has, on its surface that holds the liquid crystal, the source bus lines 21, the gate bus lines 22, and the picture elements 23 (see FIG. 2). It should be noted that FIG. 2 illustrates mainly an effective display region of the liquid crystal panel 20, which effective display region includes 768 pixels×1366 pixels (each pixel 24 includes two picture elements 23×two picture elements 23).

The source bus lines 21 are provided so as to extend in a vertical direction, and the number of the source bus lines 21 is the number of columns of picture elements 23+1 (in FIG. 2, 2773 source bus lines S1 to S2773 are provided). One end of each of the source bus lines 21 is connected to the source driver 18.

The gate bus lines 22 are provided so as to extend in a horizontal direction, and the number of the gate bus lines 22 is the number of rows of picture elements 23+α (in FIG. 2, 1536+4 gate bus lines are provided). One end of each of the gate bus lines 22 is connected to the gate driver 19. The gate bus lines 22 include gate bus lines G1 to G1536 and gate bus lines GD0 to GD3. The gate bus lines G1 to G1536 are connected to corresponding picture elements 23 (those involved in display) provided in the effective display region, and the gate bus lines GD0 to GD3 are connected to corresponding picture elements 23 (those not involved in display) provided in a non-display region (not illustrated). In a plan view shown in FIG. 2, the gate bus lines 22 are arranged, from top, in order of the gate bus lines GD0 and GD1, the gate bus lines G1 to G1536, and the gate bus lines GD2 and GD3.

The picture elements 23 are a plurality of picture elements 23 provided in a matrix manner (1536×2772 picture elements are provided in the effective display region, and 4×2772 picture elements are provided in the non-display region). Each of the picture elements 23 is connected to a corresponding source bus line 21 via for example a TFT (not illustrated) connected to the source bus line 21.

Specifically, the TFTs of respective picture elements in each row have gate terminals connected to an identical gate bus line 22 corresponding thereto. The TFTs of respective picture elements 23 in each column have source terminals connected two-by-two alternately to an adjacent source bus line 21 located on their left side and an adjacent source bus line 21 located on their right side. For example, picture elements 23 in the first and second rows in the effective display region are connected to an adjacent source bus line 21 located on their left side. Picture elements 23 in the third and fourth rows are connected to an adjacent source bus line 21 located on their right side.

As described above, in each column of picture elements 23, picture elements 23 connected to an adjacent source bus line 21 located on one side (left side) thereof and picture elements 23 connected to an adjacent source bus line 21 located on the other side (right side) thereof are alternately arranged two by two. That is, the liquid crystal panel 20 has a configuration of staggered arrangement.

Further, the picture elements 23 are arranged in the effective display region shown in FIG. 2 and in the non-display region (not illustrated). Picture elements 23 provided in the effective display region are scanned by the gate bus lines G1 to G1536. Picture elements 23 provided in the non-display region are scanned by the gate bus lines GD0 to GD3. In a plan view shown in FIG. 2, the picture elements 23 provided in the non-display region are provided such that two rows of them are provided at the top and two rows of them are provided at the bottom. Picture elements in the top two rows are connected to an adjacent source bus line 21 located on their right side. Picture elements in the bottom two rows are connected to an adjacent source bus line 21 located on their left side.

The other one of the transparent substrates of the liquid crystal panel 20 has, on its surface that holds liquid crystal, a color filter and a common electrode to which a common voltage is to be applied, which are stacked in the order named. The color filter is provided so that four picture elements 23 serve as one unit, in which R (red) corresponds to the upper left picture element 23, G (green) corresponds to the upper right picture element 23, B (blue) corresponds to the lower left picture element 23 and Y (yellow) corresponds to the lower right picture element 23. In this way, in the liquid crystal panel 20, two picture elements 23 adjacent to each other in a vertical direction×two picture elements 23 adjacent to each other in a horizontal direction constitute one (1) pixel 24 of RGBY.

The following description discusses a method of driving a liquid crystal display device 10 configured as above.

Figure 3:
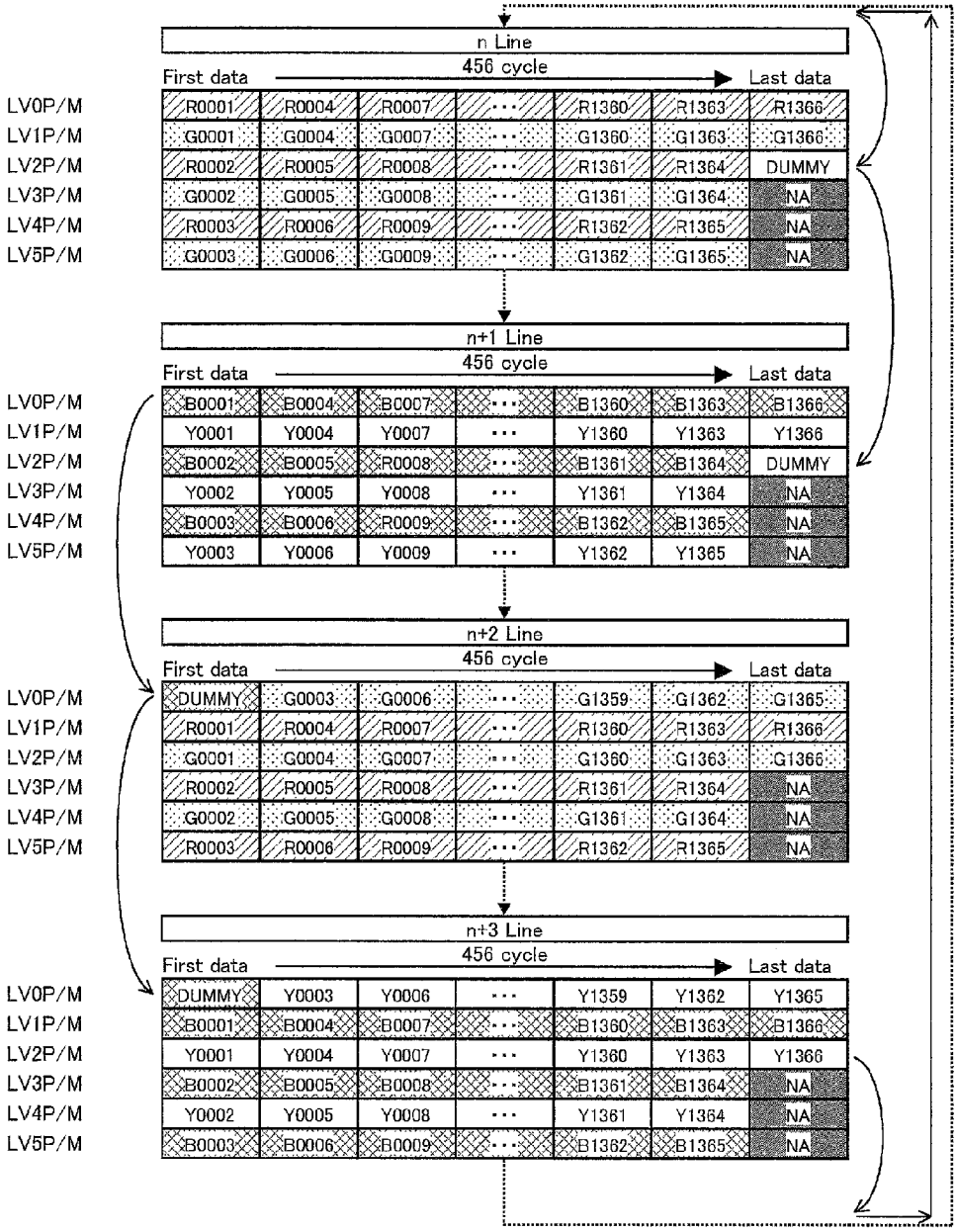
FIG. 3 is a view illustrating how a timing controller of the display device rearranges, for each row, video signals to be supplied to the liquid crystal panel.
Figure 4:
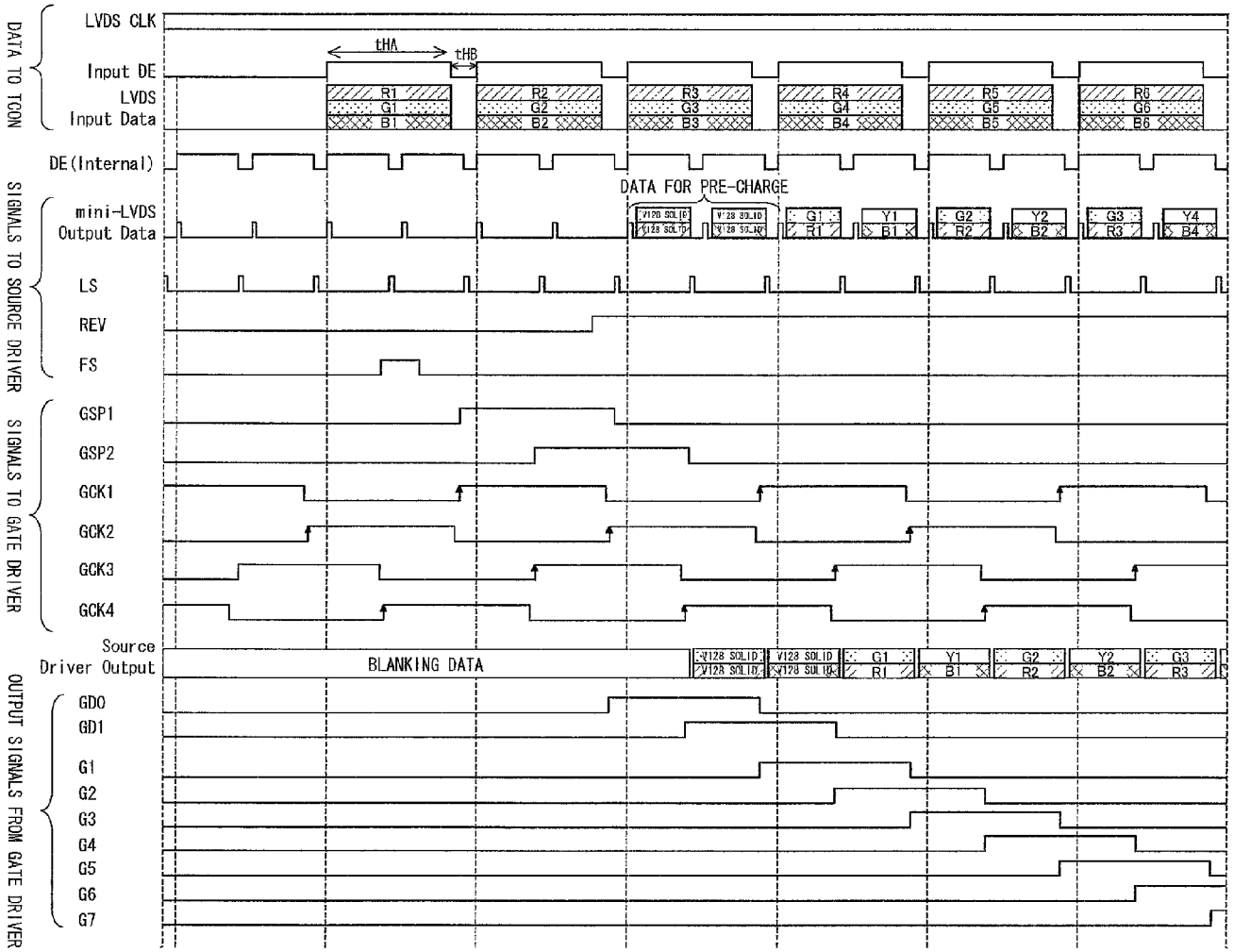
FIG. 4 is a waveform chart illustrating various signal waveforms observed around a start of a display when an image of one (1) frame is displayed on the liquid crystal panel.
Figure 5:
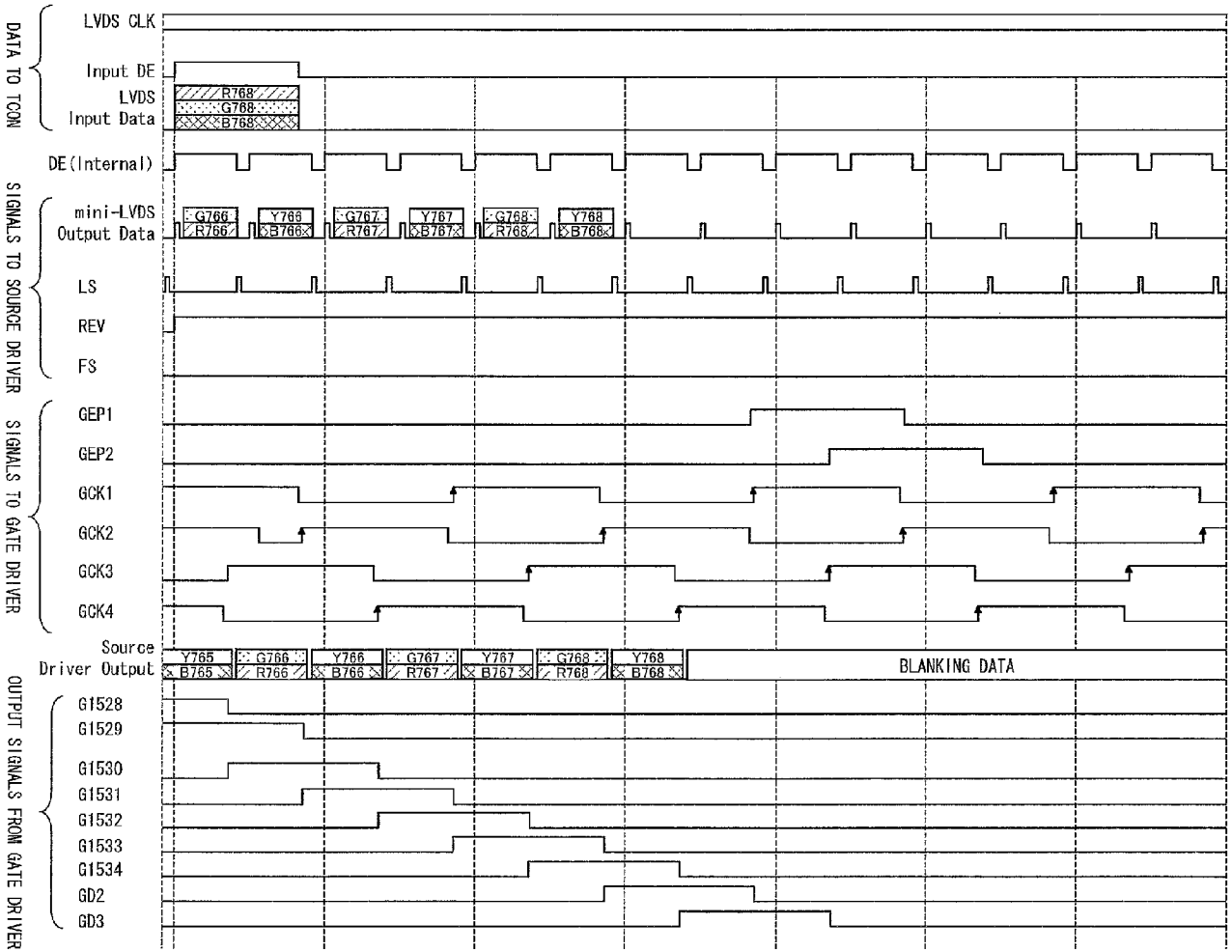
FIG. 5 is a waveform chart illustrating various signal waveforms observed around an end of a display when an image of one (1) frame is displayed on the liquid crystal panel.

FIG. 3 is a view illustrating how the video signal mapping section 15 of the timing controller 11 rearranges, for each row, video signals to be supplied to the liquid crystal panel 20. FIG. 4 is a waveform chart illustrating various signal waveforms observed around a start of a display when an image of one (1) frame is displayed on the liquid crystal panel 20. FIG. 5 is a waveform chart illustrating various signal waveforms observed around an end of a display when an image of one (1) frame is displayed on the liquid crystal panel 20.

The liquid crystal display device 10 carries out pseudo-dot reversal driving by combining source bus line reversal driving and a picture element matrix in which picture elements are arranged in a staggered manner. That is, since (i) the source driver 18 supplies output to each source bus line 21 so that the polarity of the output is constant in a frame period and is reverse to that of an adjacent source bus line 21 and the liquid crystal panel 20 has staggered arrangement, the liquid crystal display device 10 carries out substantially dot reversal driving. In addition, in order to cause all picture elements 23 in a row to reach a desired electric potential within a horizontal period, the liquid crystal display device 10 carries out pre-charging with use of data signals that were supplied to the source bus lines 21 during a previous horizontal period that is one period preceding the foregoing horizontal period, i.e., with use of previous output.

When a display is started, video signals for pixels in a single pixel row are supplied to the timing controller 11 in accordance with a clock signal LVDS_CLK for LVDS transmission. The timing controller 11 is sequentially supplied with video signals (R1, G1, B1) for pixels 24 in the first pixel row to video signals (R768, G768, B768) for pixels 24 in the 768th pixel row during periods tHA at intervals of periods tHB.

First, the following description discusses a series of operations from a start of an image display (start of one (1) frame period) to a time when data signals based on the video signals (R1, G1, B1) for the pixels 24 in the first pixel row are applied to picture elements 23 of the liquid crystal panel 20.

The foregoing video signals supplied to the timing controller 11 are received by the video signal receive section 12, are subjected to image processing by the image processing section 13, are temporarily retained in the line buffer section 14, and then are supplied to the video signal mapping section 15.

Upon receiving the video signals for the pixels 24 in the first pixel row, the video signal mapping section 15 generates data for pre-charging prior to generating video signals to be supplied to the pixels 24 in the first pixel row, i.e., video signals to be supplied to picture elements 23 in the first and second rows in the effective display region. The data for pre-charging is data that is to be supplied to all of the source bus lines 21, and is generated in accordance with a gray scale set in advance. Further, the data for pre-charging serves also as data to be written into picture elements 23 in the first and second rows in the non-display region.

The video signal mapping section 15 (i) generates, as data to be supplied to picture elements 23 in the first row in the non-display region, for example pieces of solid color data corresponding to R and G of 128 gray scales, (ii) rearranges the pieces of the solid color data into groups each including six of them, and (iii) supplies them to the video signal transmission section 16. Subsequently, the video signal mapping section 15 (a) generates, as data to be supplied to picture elements 23 in the second row in the non-display region, for example pieces of solid color data corresponding to B and Y of 128 gray scales, (b) rearranges the pieces of solid color data into groups each including six of them, and (c) supplies them to the video signal transmission section 16.

This causes the video signal transmission section 16 to sequentially supply the pieces of solid color data corresponding to R and G of 128 gray scales and the pieces of solid color data corresponding to B and Y of 128 gray scales to the source driver 18. Note here that, since the video signal transmission section 16 outputs data for all of the source bus lines 21 six at a time, the video signal transmission section 16 repeats such output operation 456 times to output data for one (1) row.

Subsequently, the video signal mapping section 15 rearranges video signals to be supplied to picture elements 23 corresponding to R and G in the first row (see FIG. 2), out of received video signals for the pixels 24 in the first pixel row, into groups each including six of the video signals (see n_Line in FIG. 3). Note here that, while rearranging the video signals, the video signal mapping section 15 inserts dummy data at the end, i.e., behind a video signal to be supplied to the last picture element 23 of G1366.

The dummy data used here is a piece of data in rearranged data for a previous row, which piece of data is located at the same output position as the dummy data. That is, in this case, the dummy data used is data (data corresponding to Y of 128 gray scales) supplied from a data bus LV2P/M when 456th output is carried out in a case where the pieces of data corresponding to B and Y of 128 gray scales generated as data for pre-charging are rearranged. In other words, the dummy data used here is data corresponding to output supplied to the source bus line S2773 in a previous row.

Then, the video signal mapping section 15 supplies, to the video signal transmission section 16, video signals which have been rearranged and to which dummy data has been inserted as above. This causes the video signal transmission section 16 to supply video signals for the first row to the source driver 18.

Subsequently, the video signal mapping section 15 rearranges video signals to be supplied to picture elements 23 corresponding to B and Y in the second row (see FIG. 2), out of received video signals for the pixels 24 in the first pixel row, into groups each including six of video signals (see n+1_Line in FIG. 3). Note here that, while rearranging video signals, the video signal mapping section 15 inserts dummy data at the end, i.e., behind a video signal to be supplied to the last picture element 23 of Y1366.

The dummy data used here is a piece of data in rearranged data for a previous row, which piece of data is located at the same output position as the dummy data. That is, in this case, the dummy data used is data (data corresponding to Y of 128 gray scales) supplied from a data bus LV2P/M when 456th output is carried out in a case where the pieces of data for the first row, i.e., previous row, are rearranged.

Then, the video signal mapping section 15 supplies, to the video signal transmission section 16, video signals which have been rearranged and to which dummy data has been inserted as above. This causes the video signal transmission section 16 to supply video signals for the second row to the source driver 18.

On the other hand, upon receiving the video signals for the pixels 24 in the first pixel row, the video signal mapping section 15 supplies a notification signal to the source driver/gate driver control signal generation section 17. The source driver/gate driver control signal generation section 17 supplies a frame start signal FS and subsequently a reversal signal REV to the source driver 18, in accordance with the notification signal. Further, the source driver/gate driver control signal generation section 17 supplies gate start pulses GSP1 and GSP2 to the gate driver 19. The source driver/gate driver control signal generation section 17 supplies such signals before the video signal transmission section 16 outputs pieces of solid color data corresponding to R and G of 128 gray scales.

Note that, the source driver/gate driver control signal generation section 17 supplies a latch signal LS to the source driver 18 for every horizontal period, and supplies gate clock signals GCK1 to GCK4 to the gate driver 19. The gate clock signals GCK1 to GCK4 have respective different phases. The gate clock signals GCK3 and GCK4, which are opposite in phase to each other, lag behind by one (1) horizontal period the gate clock signals. GCK1 and GCK2, which are opposite in phase to each other.

The source driver 18 is supplied with, in accordance with the latch signal LS, video signals that the video signal transmission section 16 of the timing controller 11 outputs. After receiving video signals for one (1) row, the source driver 18 generates data signals corresponding to the respective video signals and supplies, at once, the data signals for one (1) row to the source bus lines 21 of the liquid crystal panel 20.

When output is supplied to the picture elements 23 in the first and second rows in the non-display region, data signals based on the foregoing solid color data are supplied to the source bus lines S1 to S2773. When output is supplied to the picture elements 23 in the first and second rows in the effective display region, data signals based on the foregoing video signals are supplied to the source bus lines S1 to S2772 and a data signal based on dummy data is supplied to the source bus line S2773.

Further, when output is supplied to each line like above, in accordance with the reversal signal REV, for example, the odd-numbered source bus lines S1, S3, . . . , and S2773 are supplied with data signals having positive polarities, and the even-numbered source bus lines S2, S4, . . . , and S2772 are supplied with data signals having negative polarities. It should be noted that positive and negative polarities are switched for every one (1) frame in accordance with the reversal signal REV.

The gate driver 19 has started scanning the gate bus lines 22 in accordance with the gate start pulses GSP1 and GSP2. Scanning signals supplied to the respective gate bus lines 22 are generated in synchronization with the gate clock signals GCK1 to GCK4, and outputted so that the second half of each output period serves as one (1) horizontal period during which corresponding data signals are written into the picture elements 23.

First, a scanning signal is supplied to a gate bus line GD0. This causes (i) pieces of blanking data to be written into picture elements 23 connected to the gate bus line GD0, i.e., the picture elements 23 in the first row of the non-display region, during the first half of an output period and (ii) data signals based on pieces of solid color data corresponding to R and G of 128 gray scales to be written into these picture elements 23 during the second half of the output period.

Subsequently, one (1) horizontal period after the scanning signal is supplied to the gate bus line GD0, a scanning signal is supplied to a gate bus line GD1. This causes (i) the data signals based on the pieces of solid color data corresponding to R and G of 128 gray scales to be written into picture elements 23 connected to the gate bus line GD1, i.e., the picture elements 23 in the second row of the non-display region, during the first half of an output period and (ii) data signals based on pieces of solid color data corresponding to B and Y of 128 gray scales to be written into these picture elements 23 during the second half of the output period.

Subsequently, one (1) horizontal period after the scanning signal is supplied to the gate bus line GD1, a scanning signal is supplied to a gate bus line G1. This causes (i) the data signals based on the pieces of solid color data corresponding to B and Y of 128 gray scales to be written into picture elements 23 connected to the gate bus line G1, i.e., the picture elements 23 in the first row of the effective display region, during the first half of an output period and (ii) data signals for the first row to be written into these picture elements 23 during the second half of the output period.

Subsequently, one (1) horizontal period after the scanning signal is supplied to the gate bus line G1, a scanning signal is supplied to a gate bus line G2. This causes (i) the data signals for the first row to be written into picture elements 23 connected to the gate bus line G2, i.e., the picture elements 23 in the second row of the effective display region, during the first half of an output period and (ii) data signals for the second row to be written into these picture elements 23 during the second half of the output period.

As described above, the scanning signals are outputted so that an output period of each scanning signal overlaps in time with an output period of a scanning signal that is supplied to a previous gate bus line 22. That is, a scanning signal outputted during a certain horizontal scanning period has been outputted since a previous horizontal period. Accordingly, picture elements 23 in the (n+1)th row are pre-charged by data signals written into picture elements 23 in the nth row that is one row preceding the (n+1)th row, and thereafter are actually charged. Accordingly, even in a case where an actual charging time is short, an electric potential of a data signal that should be written can be sufficiently reached.

The following description discusses operations of input of video signals (R2, G2, B2) for pixels 24 in the second pixel row and input of video signals for later pixel rows.

The procedure returns to the operation of the timing controller 11. The video signal mapping section 15 rearranges video signals to be supplied to picture elements 23 corresponding to R and G in the third row (see FIG. 2), out of received video signals for pixels 24 in the second pixel row, into groups each including six of the video signals (see n+2_Line in FIG. 3). Note here that, while rearranging video signals, the video signal mapping section 15 inserts dummy data at the beginning, i.e., in front of a video signal to be supplied to the first picture element 23 of R0001.

The dummy data used here is a piece of data in rearranged data for a previous row, which piece of data is located at the same output position as the dummy data. That is, in this case, the dummy data used is data (data corresponding to B0001) outputted from a data bus LV0P/M when the first output is carried out in a case where the video signals for the second row, which is a previous row, are rearranged.

Then, the video signal mapping section 15 supplies, to the video signal transmission section 16, video signals which have been rearranged and into which dummy data has been inserted as above. This causes the video signal transmission section 16 to supply the video signals for the third row to the source driver 18.

Subsequently, the video signal mapping section 15 rearranges video signals to be supplied to picture elements 23 corresponding to B and Y in the fourth row (see FIG. 2), out of the received video signals for the pixels 24 in the second pixel row, into groups each including six of the video signals (see n+3_Line in FIG. 3). Note here that, while rearranging video signals, the video signal mapping section 15 inserts dummy data at the beginning, i.e., in front of a video signal to be supplied to the picture element 23 of B0001.

The dummy data used here is a piece of data in rearranged data for a previous row, which piece of data is located at the same output position as the dummy data. That is, in this case, the dummy data used is data (data corresponding to B0001) outputted from a data bus LV0P/M when the first output is carried out in a case where the video signals for the third row, which is a previous row, are rearranged.

Then, the video signal mapping section 15 supplies, to the video signal transmission section 16, video signals which have been rearranged and into which dummy data has been inserted as above. This causes the video signal transmission section 16 to supply the video signals for the fourth row to the source driver 18.

In this way, the video signal mapping section 15 repeatedly carries out the same operations with respect to video signals for pixels 24 in the third to 768th pixel rows. That is, the video signal mapping section 15 repeats, for each row, the operation of (i) rearranging video signals and (ii) inserting dummy data obtained from a previous row at the beginning or at the end depending on a row to which the video signals are to be supplied (see FIG. 3).

Specifically, in a case of a row in which picture elements are connected to their adjacent source bus lines 21 located on their left side such as the first and second rows (i.e., a row in which the leftmost picture element 23 is connected to the leftmost source bus line S1 and the rightmost picture element 23 is connected to the source bus line S2772 that is next to the rightmost source bus line), the video signal mapping section 15 inserts, at the end of rearranged pieces of data, dummy data obtained from a previous row.

In a case of a row in which picture elements are connected to their adjacent source bus lines 21 located on their right side such as the third and fourth rows (i.e., a row in which the leftmost picture element 23 is connected to the source bus line S2 that is next to the leftmost source bus line and the rightmost picture element 23 is connected to the rightmost source bus line S2773), the video signal mapping section 15 inserts, at the beginning of rearranged pieces of data, dummy data obtained from a previous row.

The source driver 18 is supplied with, in accordance with the latch signal LS, video signals which the video signal transmission section 16 of the timing controller 11 outputs. After receiving video signals for one (1) row, the source driver 18 generates data signals corresponding to the video signals and supplies, at once, the data signals for one (1) row to the source bus lines 21 of the liquid crystal panel 20.

When output is supplied to the picture elements 23 in the third and fourth rows, a data signal based on dummy data is supplied to the source bus line S1 and data signals based on the foregoing video signals are supplied to the source bus lines S2 to S2773.

Subsequently, when output is supplied to the picture elements 23 in the fifth and sixth rows, data signals based on the foregoing video signals are supplied to the source bus lines S1 to S2772 and a data signal based on dummy data is supplied to the source bus line S2773.

In this way, the same operations are repeated until output to picture elements 23 in the 1536th row is carried out. That is, when output is supplied to a row in which picture elements 23 are connected to their adjacent source bus lines 21 located on their left side, data signals based on the foregoing video signals are supplied to the source bus lines S1 to S2772 and a data signal based on dummy data is supplied to the source bus line S2773. When output is supplied to a row in which picture elements 23 are connected to their adjacent source bus lines 21 located on their right side, a data signal based on dummy data is supplied to the source bus line S1 and data signals based on the foregoing video signals are supplied to the source bus lines S2 to S2773.

One (1) horizontal period after the scanning signal is supplied to the gate bus line G2, the gate driver 19 supplies a scanning signal to a gate bus line G3. This causes (i) the data signals for the second row to be written into picture elements 23 connected to the gate bus line G3, i.e., the picture elements 23 in the third row, during the first half of an output period and (ii) data signals for the third row to be written into these picture elements 23 during the second half of the output period.

Subsequently, one (1) horizontal period after the scanning signal is supplied to the gate bus line G3, a scanning signal is supplied to a gate bus line G4. This causes (i) data signals for the third row to be written into picture elements 23 connected to the gate bus line G4, i.e., the picture elements 23 in the fourth row, during the first half of an output period and (ii) data signals for the fourth row to be written into these picture elements 23 during the second half of the output period.

In this way, the same operations are repeated until output to the picture elements 23 in the 1536th row is carried out. That is, scanning signals are sequentially supplied to the gate bus lines G5 to G1536, thereby picture elements 23 in each row are pre-charged by previous output during the first half of an output period and are actually charged during the second half of the output period. Lastly, scanning signals are supplied to the gate bus lines GD2 and GD3, and blanking data are written to the undermost picture elements 23 in the non-display region.

This causes driving for one (1) frame to end (causes a transition into a blanking period), and an image of one (1) frame can be displayed on the liquid crystal panel 20. The liquid crystal display device 10 is capable of carrying out dot reversal driving substantially, because (i) the source driver 18 supplies output to each source bus line 21 so that the polarity of the output is constant in a frame period and is reverse to that of an adjacent source bus line 21 and (ii) the liquid crystal panel 20 has staggered arrangement.

Note here that, while the source driver 18 is supplying output to for example picture elements 23 in the second row, the source bus line S2773 is being supplied with a data signal based on dummy data. Conventionally, a source bus line S2773 at this time is regarded as blank, i.e., regarded as a non-display region, because the source bus line S2773 at this time is connected to no picture element 23, and is supplied with a lowest gray scale voltage (e.g., a black voltage in a case of normally black). Therefore, there has been a problem in which (i) the rightmost picture element 23 in the third row is not pre-charged, at which third row connection of the picture elements 23 to source bus lines 21 is switched from that in a previous row and therefore (ii) it is not possible to cause the rightmost picture element 23 to reach a desired electric potential within a horizontal period in which data signals are written into picture elements 23 in the third row.

In contrast, according to the liquid crystal display device 10, as described earlier, the source bus line S2773 is supplied with a data signal based on dummy data obtained from a previous row. Therefore, the liquid crystal display device 10 is capable of causing the rightmost picture element 23 to sufficiently reach a desired electric potential by carrying out pre-charging with use of this data signal.

As has been described, according to the liquid crystal display device 10, in each horizontal period, a data signal that was supplied in a previous horizontal period is supplied to the source bus line S1 or to the source bus line S2773, which is not connected to a picture element 23 to which a data signal is to be written during the foregoing each horizontal period. This prevents source output voltages in a pre-charging period from being different between (i) the leftmost and rightmost picture elements 23 and (ii) the other picture elements 23 in each of the odd-numbered rows, i.e., a row at which connection of the picture elements 23 to the source bus lines 21 is switched from that in a previous row, and thus makes it possible to cause liquid crystal to be evenly charged.

As such, even in a case of the liquid crystal panel 20 in which the picture elements 23 are arranged in a staggered manner, it is possible to eliminate, while carrying out pre-charging with use of output for a previous row, dot-like unevenness which occurs in the left and right edge portions of a display screen.

The foregoing descriptions discussed Embodiment 1. Note, however, that the staggered arrangement is not essential. The picture elements and gate bus lines in the non-display region are not essential. Further, the order in which picture elements are selected for actual charging does not necessarily have to be the order in which the rows are arranged, and therefore interlacing scanning for selecting rows of picture elements with skipping can be employed.

The liquid crystal display device 10 can be a liquid crystal display device including: picture elements 23 in each column of an effective display region, some of the picture elements 23 being connected to an adjacent source bus line 21 located on one side of the picture elements 23 and the others being connected to an adjacent source bus line 21 located on the other side of the picture elements 23, wherein a period that is equivalent in length to one horizontal period and immediately precedes a first period serves as a zeroth period, the first period being a horizontal period during which a signal finishes being written first in the effective display region, during each kth period (k is an integer from 0 to n) of successive periods from the zeroth period to a nth period (n is an integer) which is a horizontal period during which a signal finishes being written lastly in the effective display region, each source bus line 21 is supplied with a signal whose electric potential polarity relative to a common electric potential is constant and whose electric potential polarity is reverse to that of a signal supplied to a source bus line 21 that is adjacent to said each source bus line 21, a picture element 23 to which a signal finishes being written within the kth period in the effective display region is caused to be in a selected state from a (k−1)th period to the kth period so as to be conductive to a source bus line 21 connected thereto, and during each kth period ($1 \leq k \leq n-1$) for the effective display region, a source bus line 21 that is not connected to a picture element 23 to which a signal finishes being written within the kth period is supplied with a signal that was supplied to this source bus line 21 during the (k−1)th period.

Note that, in the following description, configurations other than a configuration described in the present embodiment are the same as those described in Embodiment 1. For convenience of description, members having functions identical to those illustrated in the drawings of Embodiment 1 are assigned identical referential numerals, and their descriptions are omitted here.

Embodiment 2

In the foregoing liquid crystal display device 10, the liquid crystal panel 20 is not limited to those having a configuration shown in FIG. 2. How to arrange the picture elements 23 which constitute the pixels 24 and how many of picture elements 23 in each row are connected to an adjacent source bus line 21 located on the left side and how many of the picture elements 23 in each row are connected to an adjacent source bus line 21 located on the right side in the staggered arrangement can be changed as appropriate depending on a design. For example, it is possible to employ a liquid crystal display panel 30 as shown in FIG. 6.

Figure 6:
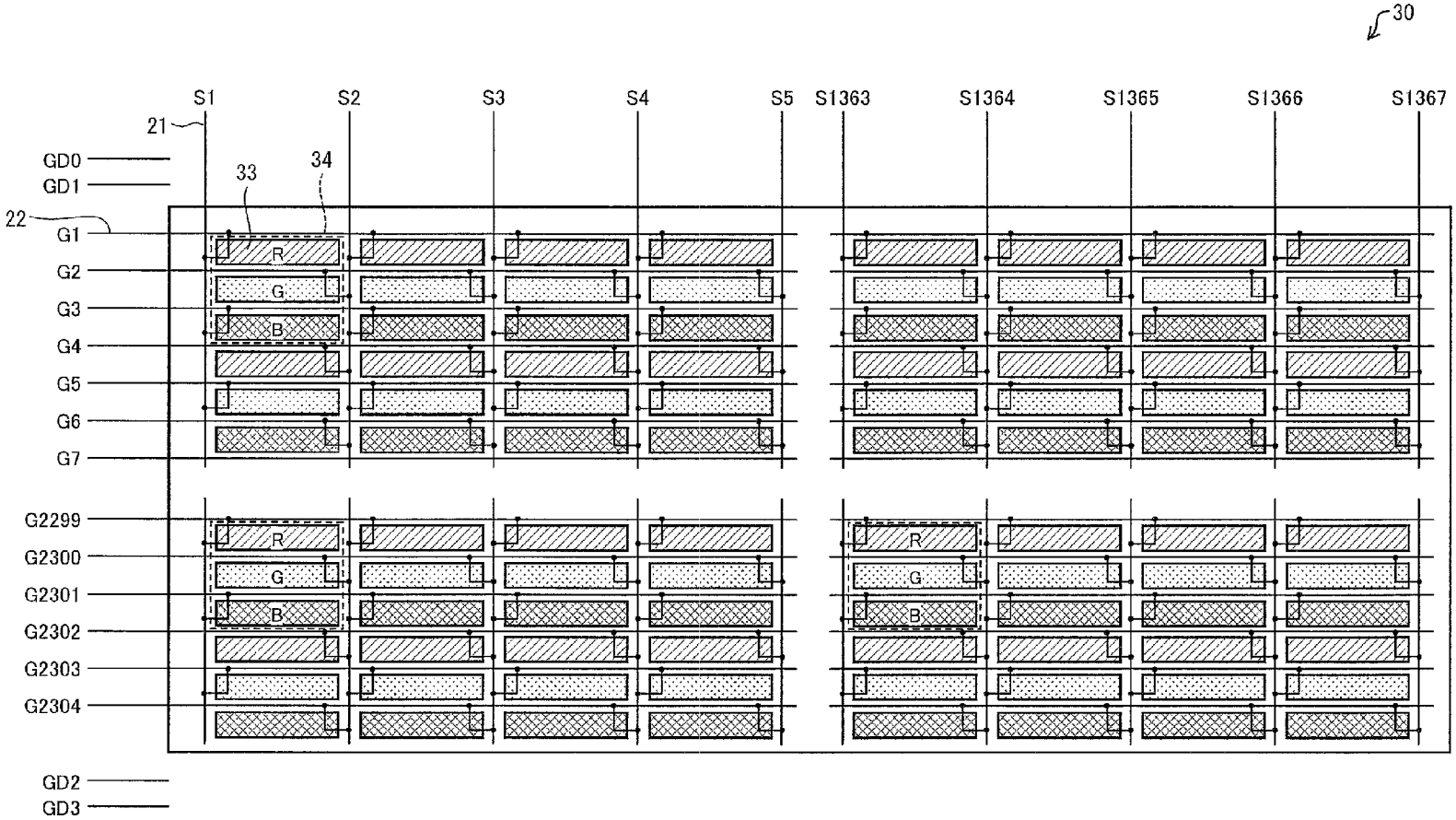
FIG. 6 is a plan view illustrating another configuration of a liquid crystal panel of the display device.

FIG. 6 is a plan view illustrating an example of a configuration of the liquid crystal panel 30. Note that FIG. 6 shows a case where an effective display region of the liquid crystal panel 30 includes 768 pixels×1366 pixels. Further, FIG. 6 illustrates characteristic parts, and omits the other parts and well-known configurations as appropriate.

The liquid crystal panel 30 is different from the liquid crystal display panel 20 of Embodiment 1 in terms of arrangement of picture elements 33 which constitute a pixel 34 (see FIG. 6). Picture elements 33 in each row are connected to an identical gate bus line 22 corresponding thereto. Picture elements 33 in each column are connected one-by-one alternately to their adjacent source bus lines 21 located on their left and right sides. That is, the liquid crystal panel 30 has a configuration of staggered arrangement.

A color filter is arranged so that three picture elements 33 serve as one unit, in which R corresponds to the upper picture element 33, G corresponds to the middle picture element 33, and B corresponds to the lower picture element 33. In this way, in the liquid crystal panel 30, three picture elements 33 adjacent to one another in a vertical direction constitute one (1) pixel 34 of RGB.

The following description discusses a method of driving the liquid crystal display device 10 having the liquid crystal panel 30.

Figure 7:
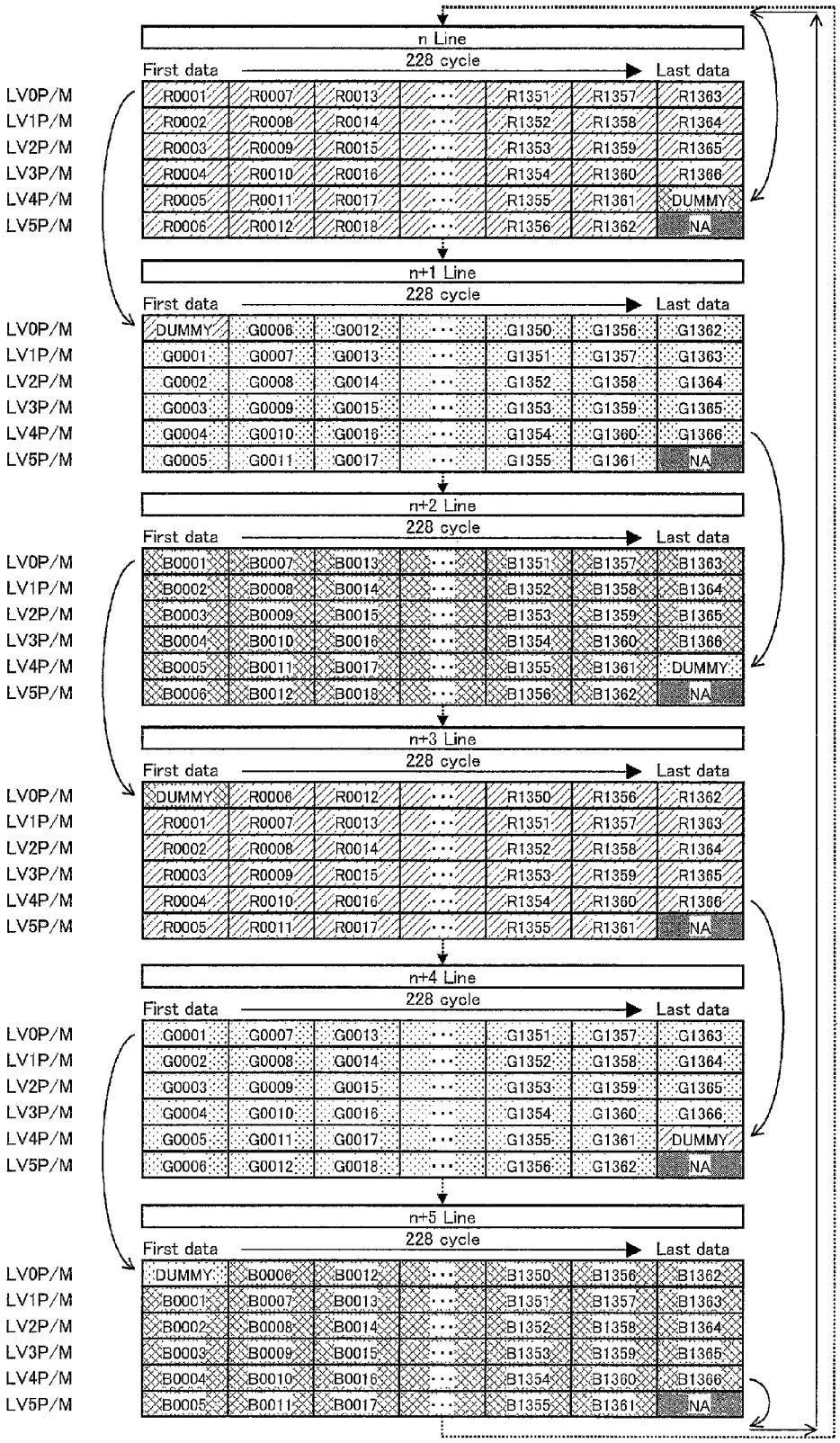
FIG. 7 is a view illustrating how a timing controller of the display device rearranges, for each row, video signals to be supplied to the liquid crystal panel.
Figure 8:
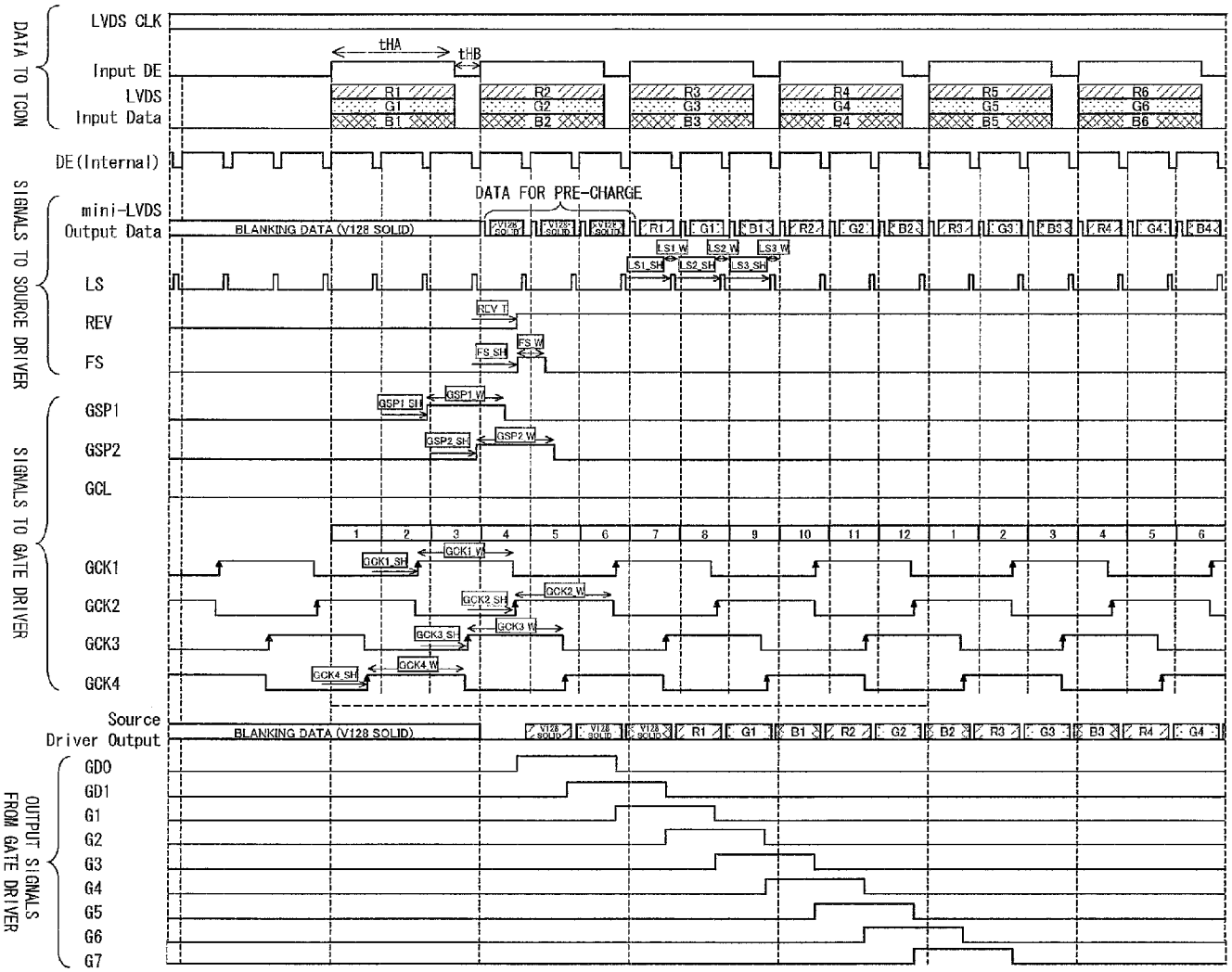
FIG. 8 is a waveform chart illustrating various signal waveforms observed around a start of a display when an image of one (1) frame is displayed on the liquid crystal panel.
Figure 9:
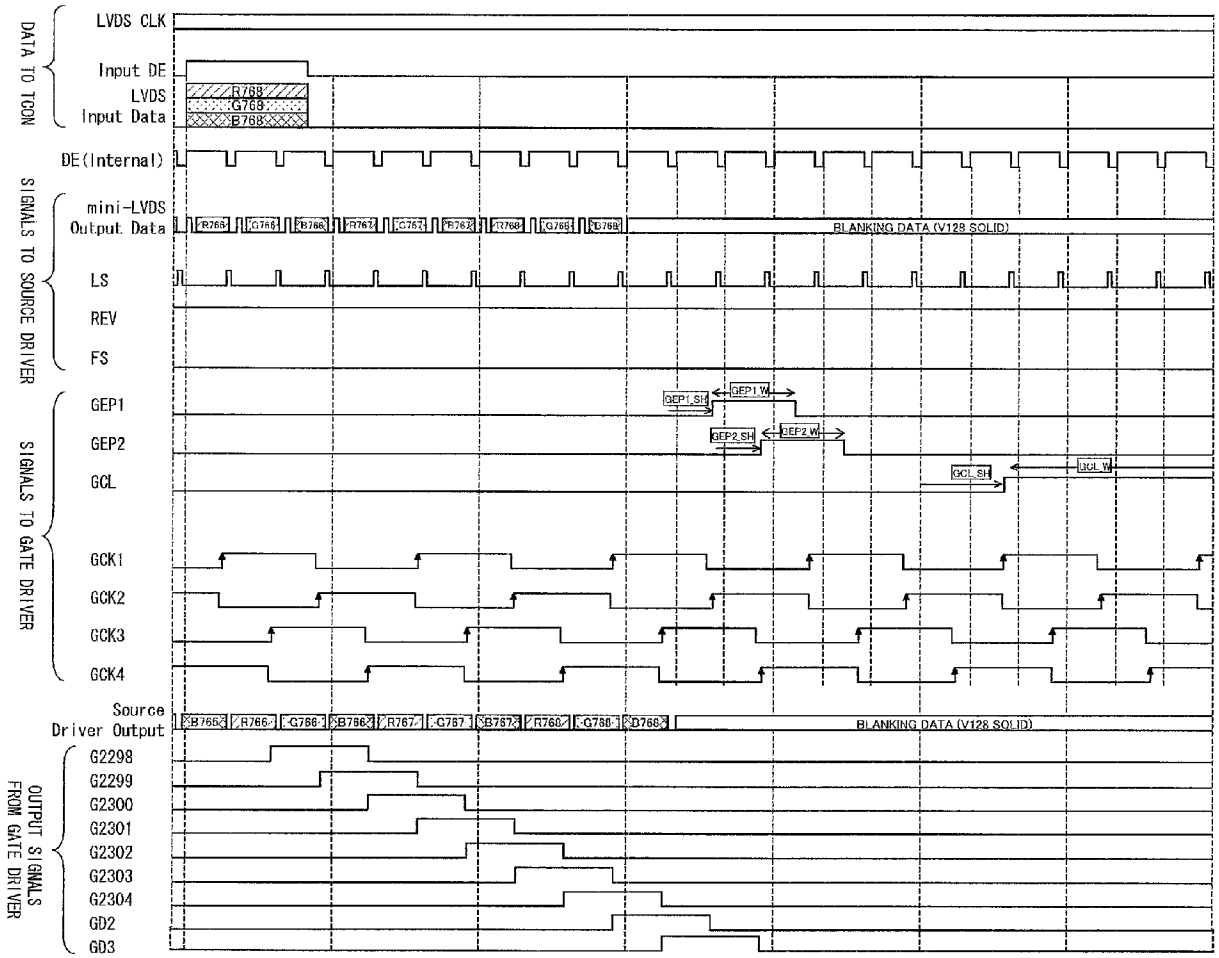
FIG. 9 is a waveform chart illustrating various signal waveforms observed around an end of a display when an image of one (1) frame is displayed on the liquid crystal panel.

FIG. 7 is a view illustrating how the video signal mapping section 15 of the timing controller 11 rearranges, for each row, video signals to be supplied to the liquid crystal panel 30. FIG. 8 is a waveform chart illustrating various signal waveforms observed around a start of a display when an image of one (1) frame is displayed on the liquid crystal panel 30. FIG. 9 is a waveform chart illustrating various signal waveforms observed around an end of a display when an image of one (1) frame is displayed on the liquid crystal panel 30.

Basic operations, i.e., a series of operations from (i) when video signals (R1, G1, B1) for pixels 34 in the first pixel row to video signals (R768, G768, B768) for pixels 34 in the 768th pixel row are sequentially supplied to the timing controller 11 until (ii) when data signals based on the foregoing video signals are applied to the picture elements 33 of the liquid crystal panel 30, are the same as those described in Embodiment 1

Attention should be drawn to how video signals are rearranged by the video signal mapping section 15 of the timing controller 11. Specifically, according to the liquid crystal panel 30, picture elements 33 in each column are one-by-one alternately connected to their adjacent source bus lines 21 located on their left and right sides. Therefore, the video signal mapping section 15 repeats, for each row, operations of rearranging video signals and inserting, at the beginning or at the end, dummy data obtained from a previous row (see FIG. 7)

By such operations, in the liquid crystal display device 10, in each horizontal period, a data signal that was supplied in a previous horizontal period is supplied to the source bus line S1 or the source bus line S2773, which is not connected to a picture element 33 to which a data signal is to be written during the foregoing each horizontal period. This prevents source output voltages in a pre-charging period from being different between (i) the leftmost or rightmost picture elements 33 and (ii) the other picture elements 33 in each row, i.e., in a row at which connection of the picture elements 33 to the source bus lines 21 is switched from that in a previous row, and thus makes it possible to cause liquid crystal to be evenly charged.

As such, even in a case of the liquid crystal panel 30 in which the picture elements 33 are arranged in a staggered manner, it is possible to eliminate, while carrying out pre-charging with use of output for a previous row, dot-like unevenness which occurs in the left and right edge portions of a display screen.

Embodiment 3

Figure 10:
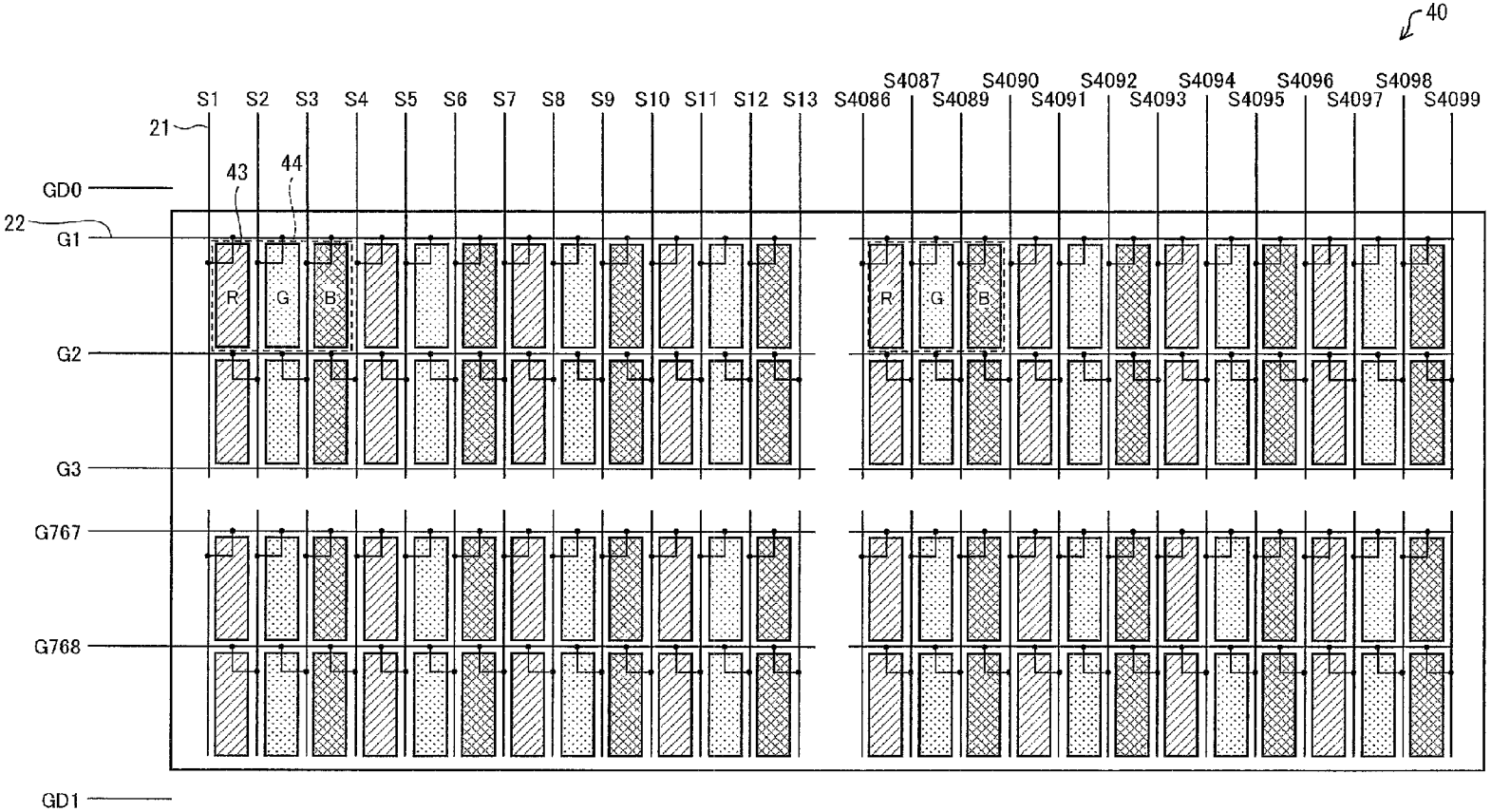
FIG. 10 is a plan view illustrating a further configuration of a liquid crystal panel of the display device.
Figure 11:
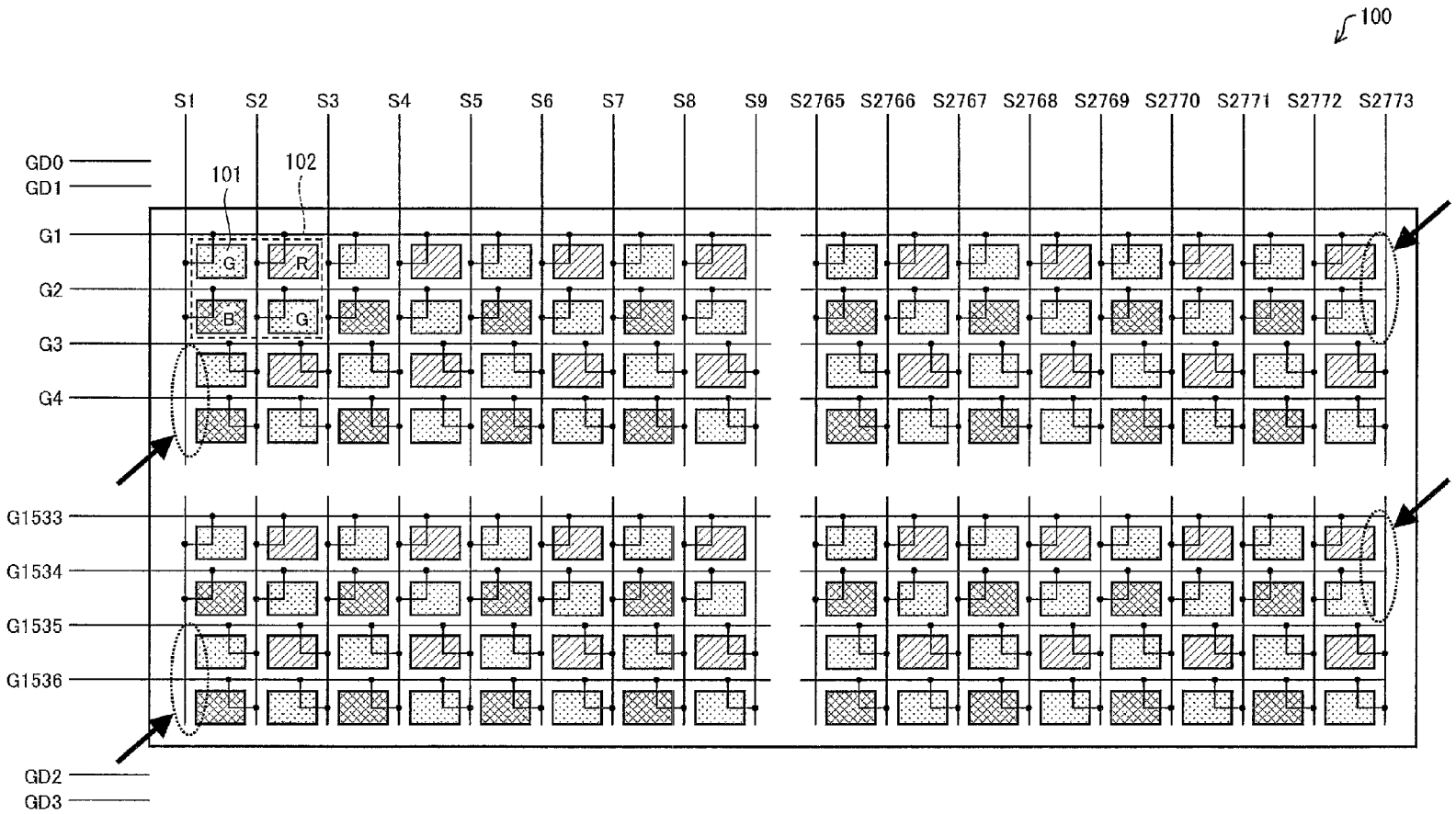
FIG. 11 is a plan view illustrating staggered arrangement in a liquid crystal panel of a conventional display device.
Figure 12:
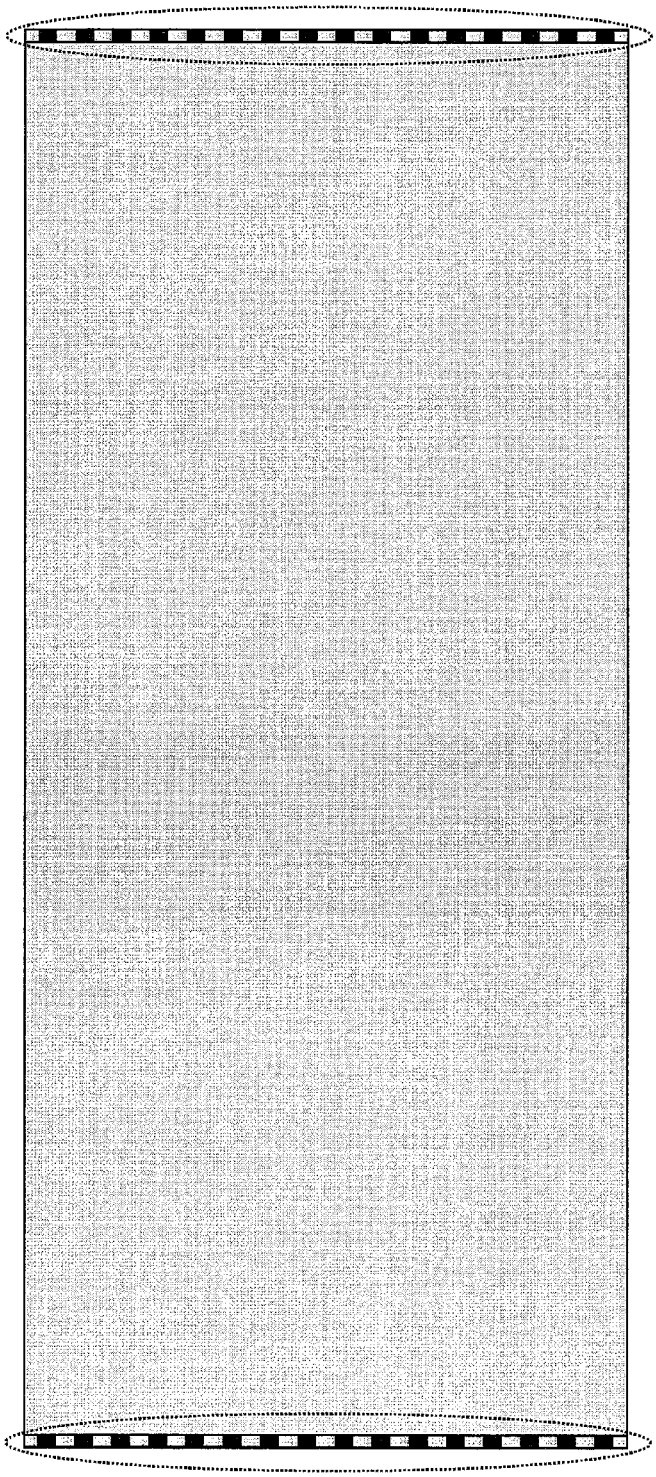
FIG. 12 is a view illustrating display unevenness occurred in the liquid crystal panel.

The foregoing liquid crystal display device 10 may include for example a liquid crystal panel 40 as shown in FIG. 10. FIG. 10 is a plan view illustrating an example of a configuration of the liquid crystal display panel 40. Note that FIG. 10 illustrates a case where an effective display region of the liquid crystal panel 40 includes 768 pixels×1366 pixels. FIG. 10 illustrates characteristic parts, and omits the other parts and well-known configurations.

The liquid crystal panel 40 is different from the liquid crystal display panel 30 of Embodiment 2 in terms of arrangement of picture elements 34 which constitute a pixel 43 (see FIG. 10). A color filter is arranged so that three picture elements 43 serve as one unit, in which R corresponds to the left picture element 43, G corresponds to the middle picture element 43, and B corresponds to the right picture element 43. In this way, in the liquid crystal panel 40, three picture elements 43 adjacent to one another in a horizontal direction constitute one (1) pixel 44 of RGB.

The liquid crystal display device 10 having the liquid crystal panel 40 is capable of eliminating, while carrying out pre-charging with use of output for a previous row, dot-like unevenness which occurs in the left and right edge portions of the display screen, by being driven in the same manner as in the liquid crystal display device 10 having the liquid crystal panel 30 of Embodiment 2.

Embodiment 4

According to the foregoing liquid crystal display device 10, the video signal mapping section 15 of the timing controller 11 inserts, when rearranging video signals, dummy data obtained from a previous row. By such operations, in each horizontal period, a data signal that was supplied in a previous horizontal period is supplied to the source bus line S1 or the source bus line S2773, which is not connected to a picture element 23 to which a data signal is to be written during the foregoing each horizontal period.

Note, however, that the dummy data is not limited to the above. Specifically, display unevenness is caused by a difference in electric potentials that liquid crystal reaches after being charged. Therefore, from a viewpoint of pre-charging, the dummy data may be any data provided that it is close to data for actual charging and has the same polarity as the data for actual charging.

For example, gray data (halftone of each color) can be used as dummy data. In this case, the video signal mapping section 15 may insert, as dummy data, for example gray data stored beforehand, when rearranging video signals.

Alternatively, either a black voltage (a signal corresponding to a lowest luminance gray level) or a white voltage (a signal corresponding to a highest luminance gray level), which is closer to a target electric potential for actual charging, can be used as dummy data. Supplying such a voltage allows for quicker charging. This can be accomplished by a method of (i) saving, in a frame memory of a control substrate in advance, data to be displayed afterwards and (ii) determining a black voltage or a white voltage as a signal potential for pre-charging with reference to the data in the frame memory.

That is, the liquid crystal display device 10 can be configured such that, during each kth period ($1 \leq k \leq n-1$) for the effective display region, a source bus line 21 that is not connected to a picture element to which a signal finishes being written within the kth period but is connected to another picture element to which a signal finishes being written within a (k+1)th period is supplied with either a signal corresponding a lowest luminance gray level or a signal corresponding to a highest luminance gray level depending on the signal to be written to said another picture element during the (k+1)th period.

The present invention is not limited to the descriptions of the respective embodiments, but may be altered within the scope of the claims. An embodiment derived from a proper combination of technical means disclosed in different embodiments is encompassed in the technical scope of the invention.

A display device in accordance with the present invention is an active matrix display device including: picture elements in each column of an effective display region, some of the picture elements being connected to an adjacent data signal line located on one side of the picture elements and the others being connected to an adjacent data signal line located on the other side of the picture elements, wherein a period that is equivalent in length to one horizontal period and immediately precedes a first period serves as a zeroth period, the first period being a horizontal period during which a signal finishes being written first in the effective display region, during each kth period (k is an integer from 0 to n) of successive periods from the zeroth period to a nth period (n is an integer) which is a horizontal period during which a signal finishes being written lastly in the effective display region, each data signal line is supplied with a signal whose electric potential polarity relative to a common electric potential is constant and whose electric potential polarity is reverse to that of a signal supplied to a data signal line that is adjacent to said each data signal line, a picture element to which a signal finishes being written within the kth period in the effective display region is caused to be in a selected state from a (k−1)th period to the kth period so as to be conductive to a data signal line connected thereto, and during each kth period ($1 \leq k \leq n-1$) for the effective display region, a data signal line that is not connected to a picture element to which a signal finishes being written within the kth period is supplied with a signal that was supplied to this data signal line during the (k−1)th period.

Alternatively, a display device in accordance with the present invention can be an active matrix display device including: picture elements in each column of an effective display region, some of the picture elements being connected to an adjacent data signal line located on one side of the picture elements and the others being connected to an adjacent data signal line located on the other side of the picture elements, wherein a period that is equivalent in length to one horizontal period and immediately precedes a first period serves as a zeroth period, the first period being a horizontal period during which a signal finishes being written first in the effective display region, during each kth period (k is an integer from 0 to n) of successive periods from the zeroth period to a nth period (n is an integer) which is a horizontal period during which a signal finishes being written lastly in the effective display region, each data signal line is supplied with a signal whose electric potential polarity relative to a common electric potential is constant and whose electric potential polarity is reverse to that of a signal supplied to a data signal line that is adjacent to said each data signal line, a picture element to which a signal finishes being written within the kth period in the effective display region is caused to be in a selected state from a (k−1)th period to the kth period so as to be conductive to a data signal line connected thereto, and during each kth period ($1 \leq k \leq n-1$) for the effective display region, a data signal line that is not connected to a picture element to which a signal finishes being written within the kth period is supplied with a signal corresponding to gray data.

Alternatively, a display device in accordance with the present invention can be an active matrix display device including: picture elements in each column of an effective display region, some of the picture elements being connected to an adjacent data signal line located on one side of the picture elements and the others being connected to an adjacent data signal line located on the other side of the picture elements, wherein a period that is equivalent in length to one horizontal period and immediately precedes a first period serves as a zeroth period, the first period being a horizontal period during which a signal finishes being written first in the effective display region, during each kth period (k is an integer from 0 to n) of successive periods from the zeroth period to a nth period (n is an integer) which is a horizontal period during which a signal finishes being written lastly in the effective display region, each data signal line is supplied with a signal whose electric potential polarity relative to a common electric potential is constant and whose electric potential polarity is reverse to that of a signal supplied to a data signal line that is adjacent to said each data signal line, a picture element to which a signal finishes being written within the kth period in the effective display region is caused to be in a selected state from a (k−1)th period to the kth period so as to be conductive to a data signal line connected thereto, and during each kth period ($1 \leq k \leq n-1$) for the effective display region, a data signal line that is not connected to a picture element to which a signal finishes being written within the kth period but is connected to another picture element to which a signal finishes being written within a (k+1)th period is supplied with either a signal corresponding a lowest luminance gray level or a signal corresponding to a highest luminance gray level depending on the signal to be written to said another picture element during the (k+1)th period.

Further, the display device in accordance with the present invention is preferably configured such that: in the effective display region, picture elements are arranged in a matrix manner such that picture elements of (two picture elements adjacent to each other in a vertical direction×two picture elements adjacent to each other in a horizontal direction), which picture elements correspond to R, G, B and Y, respectively, serve as a single pixel; and in each column of the effective display region, picture elements connected to an adjacent data signal line located on one side of the picture elements and picture elements connected to an adjacent data signal line located on the other side of the picture elements are arranged two-by-two alternately.

Further, the display device in accordance with the present invention is preferably configured such that: in the effective display region, picture elements are arranged in a matrix manner such that three picture elements that are adjacent to one another in a vertical direction or a horizontal direction and correspond to R, G and B, respectively, serve as a single pixel; and in each column of the effective display region, picture elements connected to an adjacent data signal line located on one side of the picture elements and picture elements connected to an adjacent data signal line located on the other side of the picture elements are arranged one-by-one alternately.

A display device driving method in accordance with the present invention is a method for driving an active matrix display device including picture elements in each column of an effective display region, some of the picture elements being connected to an adjacent data signal line located on one side of the picture elements and the others being connected to an adjacent data signal line located on the other side of the picture elements, wherein a period that is equivalent in length to one horizontal period and immediately precedes a first period serves as a zeroth period, the first period being a horizontal period during which a signal finishes being written first in the effective display region, and during each kth period (k is an integer from 0 to n) of successive periods from the zeroth period to a nth period (n is an integer) which is a horizontal period during which a signal finishes being written lastly in the effective display region, each data signal line is supplied with a signal whose electric potential polarity relative to a common electric potential is constant and whose electric potential polarity is reverse to that of a signal supplied to a data signal line that is adjacent to said each data signal line, said method including the steps of: causing a picture element to which a signal finishes being written within the kth period in the effective display region to be in a selected state from a (k−1)th period to the kth period so that the picture element is conductive to a data signal line connected thereto; and during each kth period ($1 \leq k \leq n-1$) for the effective display region, supplying, to a data signal line that is not connected to a picture element to which a signal finishes being written within the kth period, a signal that was supplied to this data signal line during the (k−1)th period.

Alternatively, a display device driving method in accordance with the present invention can be a method for driving an active matrix display device including picture elements in each column of an effective display region, some of the picture elements being connected to an adjacent data signal line located on one side of the picture elements and the others being connected to an adjacent data signal line located on the other side of the picture elements, wherein a period that is equivalent in length to one horizontal period and immediately precedes a first period serves as a zeroth period, the first period being a horizontal period during which a signal finishes being written first in the effective display region, and during each kth period (k is an integer from 0 to n) of successive periods from the zeroth period to a nth period (n is an integer) which is a horizontal period during which a signal finishes being written lastly in the effective display region, each data signal line is supplied with a signal whose electric potential polarity relative to a common electric potential is constant and whose electric potential polarity is reverse to that of a signal supplied to a data signal line that is adjacent to said each data signal line, said method including the steps of: causing a picture element to which a signal finishes being written within the kth period in the effective display region to be in a selected state from a (k−1)th period to the kth period so that the picture element is conductive to a data signal line connected thereto; and during each kth period ($1 \leq k \leq n-1$) for the effective display region, supplying a signal corresponding to gray data to a data signal line that is not connected to a picture element to which a signal finishes being written within the kth period.

Alternatively, a display device driving method in accordance with the present invention can be a method for driving an active matrix display device including picture elements in each column of an effective display region, some of the picture elements being connected to an adjacent data signal line located on one side of the picture elements and the others being connected to an adjacent data signal line located on the other side of the picture elements, wherein a period that is equivalent in length to one horizontal period and immediately precedes a first period serves as a zeroth period, the first period being a horizontal period during which a signal finishes being written first in the effective display region, and during each kth period (k is an integer from 0 to n) of successive periods from the zeroth period to a nth period (n is an integer) which is a horizontal period during which a signal finishes being written lastly in the effective display region, each data signal line is supplied with a signal whose electric potential polarity relative to a common electric potential is constant and whose electric potential polarity is reverse to that of a signal supplied to a data signal line that is adjacent to said each data signal line, said method including the steps of: causing a picture element to which a signal finishes being written within the kth period in the effective display region to be in a selected state from a (k−1)th period to the kth period so that the picture element is conductive to a data signal line connected thereto; and during each kth period ($1 \leq k \leq n-1$) for the effective display region, supplying, to a data signal line that is not connected to a picture element to which a signal finishes being written within the kth period but is connected to another picture element to which a signal finishes being written within a (k+1)th period, either a signal corresponding a lowest luminance gray level or a signal corresponding to a highest luminance gray level depending on the signal to be written to said another picture element during the (k+1)th period.

Further, the display device driving method in accordance with the present invention is preferably configured such that: in the effective display region, picture elements are arranged in a matrix manner such that picture elements of (two picture elements adjacent to each other in a vertical direction×two picture elements adjacent to each other in a horizontal direction), which picture elements correspond to R, G, B and Y, respectively, serve as a single pixel; and in each column of the effective display region, picture elements connected to an adjacent data signal line located on one side of the picture elements and picture elements connected to an adjacent data signal line located on the other side of the picture elements are arranged two-by-two alternately.

Further, the display device driving method in accordance with the present invention is preferably configured such that: in the effective display region, picture elements are arranged in a matrix manner such that three picture elements that are adjacent to one another in a vertical direction or a horizontal direction and correspond to R, G and B, respectively, serve as a single pixel; and in each column of the effective display region, picture elements connected to an adjacent data signal line located on one side of the picture elements and picture elements connected to an adjacent data signal line located on the other side of the picture elements are arranged one-by-one alternately.

Industrial Applicability

The present invention is not only suitably usable in a field of a liquid crystal display device including a liquid crystal panel having staggered arrangement, but also suitably usable in a filed of a production method of a liquid crystal display device. Further, the present invention is widely usable in a field of various electric appliances each including a liquid crystal display device.

Reference Signs List

10 Liquid crystal display device (display device)
11 Timing controller
12 Video signal receive section
13 Image processing section
14 Line buffer section
15 Video signal mapping section
16 Video signal transmission section
17 Source driver/gate driver control signal generation section
18 Source driver
19 Gate driver
20, 30, 40 Liquid crystal panel
21 Source bus line (data signal line)
22 Gate bus line
23, 33, 43 Picture element
24, 34, 44 Pixel

The invention claimed is:

1. An active matrix display device comprising:

picture elements in each column of an effective display region, some of the picture elements being electrically connected to an adjacent data signal line located on one side of the picture elements and the others being electrically connected to an adjacent data signal line located on the other side of the picture elements;

a data signal driver; and a gate signal driver, wherein, a period that is equivalent in length to one horizontal period and immediately precedes a first period serves as a zeroth period, the first period being a horizontal period during which a signal finishes being written first in the effective display region, the data signal driver is configured to output, during each kth period (k is an integer from 0 to n) of successive periods from the zeroth period to a nth period (n is an integer) which is a horizontal period during which a signal finishes being written lastly in the effective display region, one of a plurality of data signals to a corresponding one of a plurality of data signal lines, each one of the plurality of data signals having an electric potential polarity relative to a common electric potential that is constant and whose electric potential polarity is reverse to that of a data signal supplied to a data signal line that is adjacent to said each data signal line, the gate signal driver is configured to output one of a plurality of gate signals to a corresponding one of a plurality of gate lines such that at least one of the picture elements to which one of the plurality of data signals finishes being written within the kth period in the effective display region is caused to be in a selected state from a (k−1)th period to the kth period so as to be conductive to a data signal line connected thereto, and the data signal driver is configured to output some of the plurality of data signals such that, during each kth period ($1 \le k \le n-1$) for the effective display region, one of the plurality of data signal lines that is not electrically connected to any one of the picture elements to which a data signal finishes being written within the kth period is supplied with a data signal that was supplied, during the (k−1)th period, to the data signal line that is not connected to any one of the picture elements within the kth period.

2. An active matrix display device comprising:

picture elements in each column of an effective display region, some of the picture elements being electrically connected to an adjacent data signal line located on one side of the picture elements and the others being electrically connected to an adjacent data signal line located on the other side of the picture elements;

a data signal driver; and a gate signal driver, wherein, a period that is equivalent in length to one horizontal period and immediately precedes a first period serves as a zeroth period, the first period being a horizontal period during which a signal finishes being written first in the effective display region, the data signal driver is configured to output, during each kth period (k is an integer from 0 to n) of successive periods from the zeroth period to a nth period (n is an integer) which is a horizontal period during which a signal finishes being written lastly in the effective display region, one of a plurality of data signals to a corresponding one of a plurality of data signal lines, each one of the plurality of data signals having an electric potential polarity relative to a common electric potential that is constant and whose electric potential polarity is reverse to that of a data signal supplied to a data signal line that is adjacent to said each data signal line, the gate signal driver is configured to output one of a plurality of gate signals to a corresponding one of a plurality of gate lines such that at least one of the picture elements to which one of the plurality of data signals finishes being written within the kth period in the effective display region is caused to be in a selected state from a (k−1)th period to the kth period so as to be conductive to a data signal line connected thereto, and the data signal driver is configured to output some of the plurality of data signals such that, during each kth period ($1 \le k \le n-1$) for the effective display region, one of the plurality of data signal lines that is not electrically connected to any one of the picture elements to which a signal finishes being written within the kth period is supplied with a signal corresponding to gray data.

3. An active matrix display device comprising:

picture elements in each column of an effective display region, some of the picture elements being electrically connected to an adjacent data signal line located on one side of the picture elements and the others being electrically connected to an adjacent data signal line located on the other side of the picture elements;

a data signal driver; and a gate signal driver, wherein, a period that is equivalent in length to one horizontal period and immediately precedes a first period serves as a zeroth period, the first period being a horizontal period during which a signal finishes being written first in the effective display region, the data signal driver is configured to output, during each kth period (k is an integer from 0 to n) of successive periods from the zeroth period to a nth period (n is an integer) which is a horizontal period during which a signal finishes being written lastly in the effective display region, one of a plurality of data signals to a corresponding one of a plurality of data signal lines, each one of the plurality of data signals having an electric potential polarity relative to a common electric potential that is constant and whose electric potential polarity is reverse to that of a data signal supplied to a data signal line that is adjacent to said each data signal line, the gate signal driver is configured to output one of a plurality of gate signals to a corresponding one of a plurality of gate lines such that at least one of the picture elements to which one of the plurality of data signals finishes being written within the kth period in the effective display region is caused to be in a selected state from a (k−1)th period to the kth period so as to be conductive to a data signal line connected thereto, and the data signal driver is configured to output some of the plurality of data signals such that, during each kth period (1≤k≤n−1) for the effective display region, one of the plurality of data signal lines that is not electrically connected to any one of the picture elements to which a data signal finishes being written within the kth period but is connected to another picture element to which a data signal finishes being written within a (k+1)th period is supplied with either (i) a data signal corresponding a lowest luminance gray level or (ii) a data signal corresponding to a highest luminance gray level, the supplying being dependent on the data signal to be written to said another picture element during the (k+1)th period.

4. The display device according to claim 1, wherein:

in the effective display region, picture elements are arranged in a matrix manner such that picture elements of (two picture elements adjacent to each other in a vertical direction×two picture elements adjacent to each other in a horizontal direction), which picture elements correspond to R, G, B and Y, respectively, serve as a single pixel; and in each column of the effective display region, picture elements connected to an adjacent data signal line located on one side of the picture elements and picture elements connected to an adjacent data signal line located on the other side of the picture elements are arranged two-by-two alternately.

5. The display device according to claim 1, wherein:

in the effective display region, picture elements are arranged in a matrix manner such that three picture elements that are adjacent to one another in a vertical direction or a horizontal direction and correspond to R, G and B, respectively, serve as a single pixel; and in each column of the effective display region, picture elements connected to an adjacent data signal line located on one side of the picture elements and picture elements connected to an adjacent data signal line located on the other side of the picture elements are arranged one-by-one alternately.

6. A method for driving an active matrix display device including picture elements in each column of an effective display region, some of the picture elements being electrically connected to an adjacent data signal line located on one side of the picture elements and the others being electrically connected to an adjacent data signal line located on the other side of the picture elements, wherein, a period that is equivalent in length to one horizontal period and immediately precedes a first period serves as a zeroth period, the first period being a horizontal period during which a signal finishes being written first in the effective display region, and during each kth period (k is an integer from 0 to n) of successive periods from the zeroth period to a nth period (n is an integer) which is a horizontal period during which a signal finishes being written lastly in the effective display region, each data signal line is supplied with a signal whose electric potential polarity relative to a common electric potential is constant and whose electric potential polarity is reverse to that of a signal supplied to a data signal line that is adjacent to said each data signal line, said method comprising:

causing a picture element to which a signal finishes being written within the kth period in the effective display region to be in a selected state from a (k−1)th period to the kth period so that the picture element is conductive to a data signal line connected thereto; and during each kth period (1≤k≤n−1) for the effective display region, supplying, to a data signal line that is not connected to a picture element to which a signal finishes being written within the kth period, a signal that was supplied to this data signal line during the (k−1)th period.

7. A method for driving an active matrix display device including picture elements in each column of an effective display region, some of the picture elements being electrically connected to an adjacent data signal line located on one side of the picture elements and the others being electrically connected to an adjacent data signal line located on the other side of the picture elements, wherein a period that is equivalent in length to one horizontal period and immediately precedes a first period serves as a zeroth period, the first period being a horizontal period during which a signal finishes being written first in the effective display region, and during each kth period (k is an integer from 0 to n) of successive periods from the zeroth period to a nth period (n is an integer) which is a horizontal period during which a signal finishes being written lastly in the effective display region, each data signal line is supplied with a signal whose electric potential polarity relative to a common electric potential is constant and whose electric potential polarity is reverse to that of a signal supplied to a data signal line that is adjacent to said each data signal line, said method comprising:

causing a picture element to which a signal finishes being written within the kth period in the effective display region to be in a selected state from a (k−1)th period to the kth period so that the picture element is conductive to a data signal line connected thereto; and during each kth period (1≤k≤n−1) for the effective display region, supplying a signal corresponding to gray data to a data signal line that is not connected to a picture element to which a signal finishes being written within the kth period.

8. A method for driving an active matrix display device including picture elements in each column of an effective display region, some of the picture elements being electrically connected to an adjacent data signal line located on one side of the picture elements and the others being electrically connected to an adjacent data signal line located on the other side of the picture elements, wherein a period that is equivalent in length to one horizontal period and immediately precedes a first period serves as a zeroth period, the first period being a horizontal period during which a signal finishes being written first in the effective display region, and during each kth period (k is an integer from 0 to n) of successive periods from the zeroth period to a nth period (n is an integer) which is a horizontal period during which a signal finishes being written lastly in the effective display region, each data signal line is supplied with a signal whose electric potential polarity relative to a common electric potential is constant and whose electric potential polarity is reverse to that of a signal supplied to a data signal line that is adjacent to said each data signal line, said method comprising:

causing a picture element to which a signal finishes being written within the kth period in the effective display region to be in a selected state from a (k−1)th period to the kth period so that the picture element is conductive to a data signal line connected thereto; and during each kth period ($1 \leq k \leq n-1$) for the effective display region, supplying, to a data signal line that is not connected to a picture element to which a signal finishes being written within the kth period but is connected to another picture element to which a signal finishes being written within a (k+1)th period, either a signal corresponding a lowest luminance gray level or a signal corresponding to a highest luminance gray level depending on the signal to be written to said another picture element during the (k+1)th period.

9. The method according to claim 6, wherein;

in the effective display region, picture elements are arranged in a matrix manner such that picture elements of (two picture elements adjacent to each other in a vertical direction ×two picture elements adjacent to each other in a horizontal direction), which picture elements correspond to R, G, B and Y, respectively, serve as a single pixel; and in each column of the effective display region, picture elements connected to an adjacent data signal line located on one side of the picture elements and picture elements connected to an adjacent data signal line located on the other side of the picture elements are arranged two-by-two alternately.

10. The method according to claim 6, wherein:

in the effective display region, picture elements are arranged in a matrix manner such that three picture elements that are adjacent to one another in a vertical direction or a horizontal direction and correspond to R, G and B, respectively, serve as a single pixel; and in each column of the effective display region, picture elements connected to an adjacent data signal line located on one side of the picture elements and picture elements connected to an adjacent data signal line located on the other side of the picture elements are arranged one-by-one alternately.

* * * * *